US007487643B2

(12) United States Patent
Chen et al.

(10) Patent No.: US 7,487,643 B2
(45) Date of Patent: Feb. 10, 2009

(54) LOOP TYPE THERMO SYPHONE, HEAT RADIATION SYSTEM, HEAT EXCHANGE SYSTEM, AND STIRLING COOLING CHAMBER

(75) Inventors: Wei Chen, Nara (JP); Masaaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 387 days.

(21) Appl. No.: 10/565,304

(22) PCT Filed: Jul. 20, 2004

(86) PCT No.: PCT/JP2004/010297

§ 371 (c)(1),
(2), (4) Date: Jan. 20, 2006

(87) PCT Pub. No.: WO2005/008160

PCT Pub. Date: Jan. 27, 2005

(65) Prior Publication Data

US 2006/0185825 A1 Aug. 24, 2006

(30) Foreign Application Priority Data

Jul. 23, 2003 (JP) ..... 2003-200656
Nov. 7, 2003 (JP) ..... 2003-378369

(51) Int. Cl.
*F25B 9/00* (2006.01)
*F28D 15/00* (2006.01)

(52) U.S. Cl. ..... 62/6; 165/104.21

(58) Field of Classification Search ..... 62/6; 165/104.21

See application file for complete search history.

(56) References Cited

U.S. PATENT DOCUMENTS 3,191,391 A * 6/1965 Muller ..... 62/3.3
4,726,199 A * 2/1988 Takano et al. ..... 62/505
5,502,582 A * 3/1996 Larson et al. ..... 349/62
5,642,622 A * 7/1997 Berchowitz et al. ..... 62/6
5,803,161 A * 9/1998 Wahle et al. ..... 165/104.21

(Continued)

FOREIGN PATENT DOCUMENTS

EP 1 312 875 A1 5/2003

(Continued)

OTHER PUBLICATIONS

Office Action dated Nov. 16, 2004 issued in basic Japanese Patent Application No. 2003-378369 with English Translation.

(Continued)

*Primary Examiner*—William C Doerrler
(74) *Attorney, Agent, or Firm*—Birch, Stewart, Kolasch & Birch, LLP

(57) ABSTRACT

A natural circulation circuit includes an evaporator surrounding a heat radiating portion of a Stirling refrigerating machine to absorb heat of the heat radiating portion through evaporation of a coolant, a condenser arranged to be higher than the evaporator to condense the coolant having gas phase, a conduit guiding the coolant from the evaporator to the condenser, and a return pipe returning the liquefied coolant from the condenser to the evaporator. In the evaporator a distance between an opening of the return pipe and an inner circumferential surface of the evaporator is smaller than that between an opening of the conduit and the inner circumferential surface.

4 Claims, 18 Drawing Sheets

U.S. PATENT DOCUMENTS

| | | | | |
|---|---|---|---|---|
| 6,272,867 | B1 * | 8/2001 | Barrash et al. | 62/6 |
| 6,442,959 | B1 * | 9/2002 | Sone | 62/333 |
| 7,017,657 | B2 * | 3/2006 | Sugito et al. | 165/104.21 |
| 2003/0024690 | A1 * | 2/2003 | Sugito | 165/104.21 |
| 2003/0136549 | A1 * | 7/2003 | Sone | 165/104.21 |
| 2004/0089012 | A1 * | 5/2004 | Chen et al. | 62/277 |
| 2005/0172644 | A1 * | 8/2005 | Zhang et al. | 62/6 |
| 2005/0210885 | A1 * | 9/2005 | Pereira et al. | 62/6 |

FOREIGN PATENT DOCUMENTS

| | | | |
|---|---|---|---|
| JP | 62-66097 | A | 3/1987 |
| JP | 62-93574 | U | 6/1987 |
| JP | 62-185364 | U | 11/1987 |
| JP | 64-48560 | U | 3/1989 |
| JP | 4-369391 | A | 12/1992 |
| JP | 6-185245 | A | 7/1994 |
| JP | 6-339767 | A | 12/1994 |
| JP | 2001-33139 | A | 2/2001 |
| JP | 2002-267377 | A | 9/2002 |
| JP | 2003-50073 | A | 2/2003 |
| JP | 2003-302178 | A | 10/2003 |
| JP | 2003-200656 | A | 11/2004 |
| JP | 2003-378369 | A | 11/2004 |
| WO | WO-02/16836 | A1 | 2/2002 |

OTHER PUBLICATIONS

Office Action (Final Decision for Rejection) dated May 17, 2005 issued in basic Japanese Patent Application No. 2003-378369 with English Translation.

Office Action dated Nov. 16, 2004 issued in basic Japanese Patent Application No. 2003-200656 with English Translation.

* cited by examiner

LOOP TYPE THERMO SYPHONE, HEAT RADIATION SYSTEM, HEAT EXCHANGE SYSTEM, AND STIRLING COOLING CHAMBER

TECHNICAL FIELD

The present invention relates generally to loop thermosyphons, heat radiation systems, heat exchange systems and Stirling refrigerators. The present invention relates particularly to heat exchange systems including an evaporator and a condenser and utilizing a coolant's circulation to exchange heat, and Stirling refrigerators equipped therewith. The present invention also relates particularly to loop thermosyphons, heat radiation systems, and Stirling refrigerators equipped therewith.

BACKGROUND ART

Conventionally, heat radiation systems employing heat sinks, heat pipes, thermosyphons and the like have been known as heat radiation systems radiating heat generated at heat sources. For a heat radiation system with a heat sink attached to a heat source, the heat sink has a significant distribution in temperature. As such, the remoter it is from the heat source, the less it contributes to heat radiation. It thus has its limit in improving heat radiation performance. In contrast, heat radiation systems employing a heat pipe, a thermosyphon or the like employ a working fluid to transfer heat generated at a heat source. As such, they have a significantly higher ability to transfer heat than a heat sink and can thus maintain high heat radiation performance.

A heat pipe is a capillarity driven heat transfer device circulating a working fluid through a capillary action of a wick arranged in a closed circuit. By contrast, a thermosyphon is a gravity driven heat transfer device utilizing a difference in density of a working fluid that is caused as the working fluid evaporates and condenses. Note that a loop thermosyphon is a thermosyphon configured to circulate a working fluid in a closed circuit formed in a loop.

A loop thermosyphon equipped Stirling refrigerator is disclosed for example in Japanese Patent Laying-Open Nos. 2003-50073 (Patent Document 1) and 2001-33139 (Patent Document 2).

Patent Document 1 discloses a system that exchanges heat of a heat radiating portion (or a heated portion) of a Stirling refrigerating machine (hereinafter also referred to as "conventionally example 1"). The system includes an evaporator and a condenser associated with the heated portion and piped and thus connected together. The condenser is positioned to be higher than the evaporator and water, hydrocarbon or a similar natural coolant is sealed to thermosyphonally transfer and radiate heat.

When the Stirling refrigerating machine starts to operate, the heat radiating portion is increased in temperature and in the evaporator a heat transfer medium is heated and thus evaporates, and flows through a pipe into the condenser. Simultaneously, as a heat radiation fan rotates, the air external to the refrigerator is introduced through a suction port into an air duct. The air passes between a fin of the condenser and is then blown out of the refrigerator through an outlet port, when the heat transfer medium is cooled and thus condensed in the condenser. The condensed heat transfer medium passes through a pipe and thus flows down to return to the evaporator. The heat transfer medium is thus naturally circulated and the Stirling refrigerating machine's heated portion has its heat radiated external to the refrigerator.

Patent Document 1: Japanese Patent Laying-Open No. 2003-50073

Patent Document 2: Japanese Patent Laying-Open No. 2001-33139

DISCLOSURE OF THE INVENTION

Problems to be Solved by the Invention

The heat exchange system as described in Conventional Example 1, however, is disadvantageous as follows:

The evaporator associated with the heated portion has connected thereto a first pipe guiding the evaporated or gaseous coolant from the evaporator to the condenser, and a second pipe returning the condensed coolant from the condenser to the evaporator.

The coolant altered into a gas in the evaporator flows into the first pipe significantly rapidly, whereas the condensed coolant flows into the evaporator at a relatively small rate. As such, the coolant flowing into the evaporator can flow into the first pipe in the form of liquid together with the rapidly flowing gas.

This will reduce the liquid coolant in the evaporator and thus provide a reduced level. As the evaporator's cooling function is exhibited mainly by the liquid coolant's evaporation, and as a result the heat exchange system's cooling function will be impaired.

Furthermore for loop thermosyphons in general the heat exchange between a heat radiating portion surrounding a heat source and an evaporator is promoted to help a working fluid in the evaporator to evaporate to provide improved cooling performance. This is effectively achieved by arranging the evaporator and the heat radiating portion in closer contact with each other, ensuring that they mutually contact over an increased area, or the like. The closer contact, the increased area or the like, however, does not ensure sufficient cooling performance. Furthermore, ensuring the increased area entails increasing the apparatus in size. As such, loop thermosyphons have been utilized only in a limited field.

The present invention has been made to overcome the above disadvantage, and it contemplates an effectively cooling loop thermosyphon, heat radiation system, heat exchange system and Stirling refrigerator equipped therewith.

MEANS FOR SOLVING THE PROBLEMS

The present heat exchange system in a first aspect includes: an evaporator surrounding a heat radiating portion to evaporate a coolant in the evaporator; a condenser condensing the coolant; a conduit guiding the coolant from the evaporator to the condenser; and a return pipe returning from the condenser to the evaporator the coolant condensed by the condenser, wherein in the evaporator a distance between an opening of the return pipe and an inner circumferential surface of the evaporator is smaller than that between an opening of the conduit and the inner circumferential surface. Thus the condensed coolant flowing through the return pipe into the evaporator can less be entangled with a stream of the gas flowing from the evaporator into the conduit. As the liquefied coolant can be prevented from flowing back into the conduit, the evaporator can accordingly be prevented from having a reduced liquid level, and as a result, the heat exchange system can be prevented from having impaired cooling function.

The present heat exchange system in a second aspect includes: a plurality of sub evaporators surrounding a heat radiating portion to evaporate a coolant in the evaporators; a condenser condensing the coolant; a conduit guiding the coolant from each of the sub evaporators to the condenser; and a return pipe returning from the condenser to each of the sub evaporators the coolant condensed by the condenser, wherein the return pipe is connected to each of the sub evaporators at a position closer to an end surface of the sub evaporator that traverses the sub evaporator's circumferential direction than the conduit is. Thus the condensed coolant flowing through the return pipe into the evaporator can less be entangled with a stream of the gas flowing from the evaporator into the conduit. As the liquefied coolant can be prevented from flowing back into the conduit, the evaporator can accordingly be prevented from having a reduced liquid level, and as a result, the heat exchange system can be prevented from having impaired cooling function.

The present heat exchange system in a third aspect includes: an evaporator divided into sub evaporators; a condenser condensing the coolant; a conduit guiding the coolant from each of the sub evaporators to the condenser; a return pipe returning from the condenser to each of the sub evaporators the coolant condensed by the condenser; and a connection pipe connecting the sub evaporators to allow the sub evaporators to communicate a liquid coolant. If the plurality of evaporators have the liquid coolant with their respective liquid levels out of balance, the levels can be adjusted. This can alleviate extreme reduction in level in each evaporator and as a result prevent the evaporator from having a reduced cooling effect.

The present heat exchange system in the first to third aspects preferably has the conduit and the return pipe connected to the evaporator at an outer circumferential surface, the return pipe protruding toward the inner circumferential surface of the evaporator to be closer to the inner circumferential surface than the conduit does. Furthermore, the return pipe is preferably bent internal to the evaporator and extends in the evaporator in a direction traversing the evaporator's axial end surface. This allows the condensed coolant to flow into the evaporator at a desired portion and hence can more effectively present the coolant from flowing back into the conduit.

Furthermore the present heat exchange system in the first to third aspects preferably has the conduit connected to the evaporator at an outer circumferential surface and the return pipe connected to the evaporator at an axial end surface. Furthermore the return pipe preferably extends in the evaporator in a direction traversing the evaporator's axial end surface. This allows the condensed coolant to flow into the evaporator at a desired portion and hence can more effectively present the coolant from flowing back into the conduit.

Thus the present heat exchange system in the first to third aspects can select a conduit and a return pipe from a plurality of variations to handle a structural constraint. The evaporator's cooling effect can be increased without the necessity of considering a structural constraint of a device having the heat exchange system applied thereto.

Furthermore the present heat exchange system in the first to third aspects preferably has the return pipe connected at an end surface axially opposite to a heat absorbing portion of a refrigerating machine. This can prevent heat transferred from a coolant having a relatively high temperature from increasing a cold portion in temperature.

Furthermore the present heat exchange system in the first to third aspects preferably has the return pipe having a plurality of openings in the evaporator. This can cause the condensed coolant to be axially dispersed and flow into the evaporator. The evaporator can operate to more effectively cool a heated portion.

Furthermore the present heat exchange system in the first to third aspects preferably has the return pipe with an opening having a diameter larger downstream than upstream in the return pipe. This allows the coolant to be uniformly dispersed and thus flow into the evaporator.

The present heat exchange system in a fourth aspect includes: an evaporator surrounding a heat radiating portion to evaporate a coolant in the evaporator; a condenser condensing the coolant; a conduit guiding the coolant from the evaporator to the condenser; a return pipe returning from the condenser to the evaporator the coolant condensed by the condenser; and a preventer provided in the evaporator to prevent a liquid coolant from flowing into the conduit. This can prevent the coolant in the evaporator from flowing from the evaporator into the conduit in the form of liquid. As the liquefied coolant can be prevented from flowing back into the conduit, the evaporator can accordingly be prevented from having a reduced liquid level, and as a result, the heat exchange system can be prevented from having impaired cooling function.

The present heat exchange system in a fifth aspect includes: an evaporator surrounding a heat radiating portion to evaporate a coolant in the evaporator; a condenser condensing the coolant; first and second conduits guiding the coolant from the evaporator to the condenser; and a return pipe returning from the condenser to the evaporator the coolant condensed by the condenser, wherein the return pipe is connected to the evaporator between locations having the first and second conduits connected to the evaporator. Thus the condensed coolant flowing through the return pipe into the evaporator can less be entangled with a stream of the gas flowing from the evaporator into the conduit. As the liquefied coolant can be prevented from flowing back into the conduit, the evaporator can accordingly be prevented from having a reduced liquid level, and as a result, the heat exchange system can be prevented from having impaired cooling function.

The present heat exchange system in the first to fifth aspects can be used to cool a heat radiating portion of a Stirling refrigerating machine.

The present Stirling refrigerator in a first aspect has the present heat exchange system in the first to fifth aspects attached to a Stirling refrigerating machine at a heat radiating portion to allow the heat exchange system to cool the heat radiating portion. The Stirling refrigerating machine included in a refrigerator will have a heat exchange system having an enhanced cooling function. As a result the refrigerator's coefficient of performance (COP) is increased.

The present loop thermosyphon includes: an evaporator depriving a heat source of heat to evaporate a working fluid in the evaporator; and a condenser externally radiating heat of the working fluid to condense the working fluid in the condenser, the evaporator and the condenser being connected to allow the working fluid to circulate between the evaporator and the condenser, wherein the evaporator at a portion abutting against the heat source is roughened at an internal wall surface thereof.

In the present loop thermosyphon preferably the evaporator includes a plurality of sub frames connected together with a brazing material to assemble the evaporator. In that case preferably the sub frames is formed of an inner frame including a surface abutting against a heat source and an outer frame that does not abut against the heat source, and a roughened and thus processed surface as described above is provided at a wall surface located opposite the surface of the inner frame that abuts against the heat source. Furthermore the processed surface is preferably provided at a top surface of a plateau provided by the inner frame protruding from the wall surface located opposite the surface abutting against the heat source.

The present Stirling refrigerator in a second aspect has a Stirling refrigerating machine mounted therein, wherein the Stirling refrigerating machine includes the above loop thermosyphon, and in the present Stirling refrigerator the loop thermosyphon's evaporator is adapted to exchange heat with a heat radiation portion of the Stirling refrigerating machine.

The present heat radiation system includes a heat radiating portion, an evaporator depriving the heat radiating portion of heat to evaporate a working fluid in the evaporator, and a condenser externally radiating heat of the working fluid to condense the working fluid in the condenser, the evaporator and the condenser being connected to allow the working fluid to circulate between the evaporator and the condenser. The evaporator is formed of an annular frame having a path therein for passing the working fluid. The annular frame has an opening closer to the heat radiating portion, as seen in a cross section including an axial line of the annular frame. The path is defined by an internal wall surface of the annular frame and an external wall surface of the heat radiating portion positioned to close the opening. The present heat exchange system is characterized in that the heat radiating portion on the external wall surface thereof at a portion facing the path is roughened.

In the present heat radiation system preferably the heat radiating portion and the annular frame are connected together with a brazing material and the heat radiating portion has a plateau protruding toward the flow path from a portion of an external wall surface of the heat radiating portion that faces the path, the plateau having a top surface provided with the processed surface.

The present Stirling refrigerator in a third aspect has a Stirling refrigerating machine mounted therein, wherein the Stirling refrigerating machine includes the heat radiation system recited in claim 23, and in the present Stirling refrigerator the evaporator is adapted to exchange heat with a heat radiation portion of the Stirling refrigerating machine.

EFFECTS OF THE INVENTION

The present heat exchange system in the first to fifth aspects can prevent a reduced level of a coolant in an evaporator to cool a heated portion more efficiently.

Furthermore the present Stirling refrigerator in the first aspect can provide a large coefficient of performance.

Furthermore the present loop thermosyphon and heat radiation system can help a working fluid in an evaporator to evaporate to cool a heated portion significantly efficiently.

Furthermore the present Stirling refrigerator in the second and third aspects can cool a heated portion significantly efficiently.

BRIEF DESCRIPTION OF THE DRAWINGS

FIG. 6 is a perspective cross section of the evaporator in the present heat exchange system in the first embodiment that has a plate preventing a liquefied coolant from flowing in.

DESCRIPTION OF THE REFERENCE SIGNS

1: Stirling refrigerating machine, 2: supporting platform, 2A: supporting portion, 3, 3A, 3B: evaporator, 4: condenser, 4A: bent pipe, 4B: fin, 4C: header pipe associated with conduit, 4D: header piper associated with return pipe, 5: pressure chamber, 6: cold head, 7: warm head, 8: conduit, 8A: opening (conduit), 8B: first conduit, 8C: second conduit, 9: return pipe, 9: opening (return pipe), 10: band, 11: outer circumferential surface, 11A: inner circumferential surface, 12: axial end surface. 13: liquid coolant area, 13A: surface of liquid, 14: gaseous coolant area, 15: circumferential end surface, 16: plate preventing a fluid from flowing in, 17: connection pipe, 18: refrigerator, 19: condenser associated with cold portion, 20: return pipe associated with cold portion, 21: conduit associated with cold portion, 22: evaporator associated with cold portion, 23: cool duct, 24: duct, 25: air blowing fan, 26: fan associated with freezer section, 27: fan associated with chiller section, 28: freezer section, 29: chiller section, 101:

Stirling refrigerating machine, 102: pressure chamber, 103: heat absorbing portion, 104: heat radiating portion, 104*b*: external wall surface, 104*c*: plateau, 104*c*1: top surface, 104*d*: processed surface, 105: supporting platform, 106: supporting portion, 107: clamping band: 110: loop thermosyphon, 111: evaporator, 112: feed pipe, 113: condenser, 113*a*: header associated with feed pipe, 113*b*: parallel pipe, 113*c*: header associated with return pipe, 113*d*: heat radiation fin, 114: return pipe, 115: inner frame, 115*a*: abutting surface, 115*b*: inner wall surface, 115*c*: plateau, 115*c*1: top surface, 115*d*: processed surface, 115*d*1: top surface, 115*e*: protrusion, 116: outer frame, 116*a*, 116*b*: hole, 117, 118: cap, 119: frame, 120: highly heat conductive grease, 121: brazing material, 123: compression section, 124: internal heat exchanger, 125: reproducer, 130: Stirling refrigerator, 131: heat transfer system associated with heat absorbing portion, 133: cool duct, 134: duct, 135: air blowing fan, 136: fan associated with freezer section, 137: fan associated with chiller section, 138: freezer section, 139: chiller section

BEST MODES FOR CARRYING OUT THE INVENTION

Hereinafter the present invention in embodiments will be described with reference to the drawings.

First Embodiment

Figure 1:
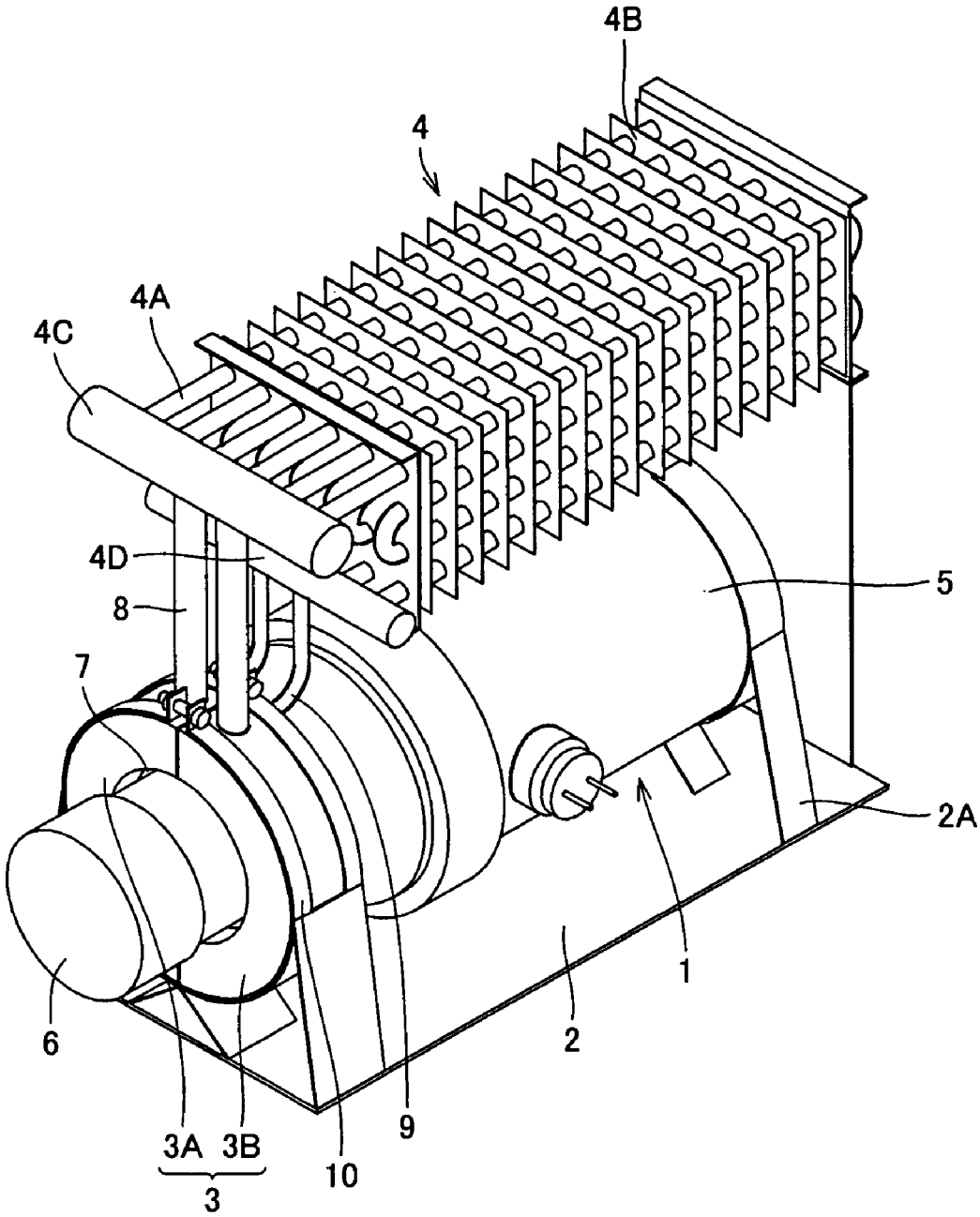
FIG. 1 is a perspective view of a Stirling refrigerating machine having the present heat exchange system in a first embodiment attached thereto.

The present embodiment provides a heat exchange system, as an example, for cooling a heated portion (or a warm head) serving as a heat radiating portion of a Stirling refrigerating machine, as shown in FIG. 1. This heat exchange system includes an evaporator 3 and a condenser 4.

Stirling refrigerating machine 1 is supported on a supporting platform 2, which supports Stirling refrigerating machine 1 by a supporting portion 2A and can fix Stirling refrigerating machine 1 at any portion of such a refrigerator utilizing the Stirling refrigerating machine. Furthermore, evaporator 3 and condenser 4 are included in a cycle radiating the heat of the heated portion that is generated as Stirling refrigerating machine 1 operates.

Stirling refrigerating machine 1 is structured as described hereinafter.

Stirling refrigerating machine 1 includes a pressure chamber 5, a cylinder disposed in pressure chamber 5, a piston reciprocating in the cylinder, a linear motor driving the piston, a displacer arranged in the cylinder opposite to the piston, a compression section disposed between the piston and the displacer, an expansion section opposite to the piston with respect to the displacer, a rear section opposite to the displacer with respect to the piston, a cold head 6 disposed opposite to the displacer with respect to the expansion section and serving as a heat absorbing portion (or a cold portion), and a warm head 7 disposed at a portion allowing the compression and expansion sections to communicate and serving as a heat radiating portion (or a heated portion).

The piston and the displacer are coaxially arranged, and the displacer has one end formed of a rod penetrating a hole provided at the center of the piston for reciprocation. Furthermore, the piston and the displacer are each supported via a spring by pressure chamber 5 closer to the rear section.

Pressure chamber 5 (the compression, expansion and rear sections) contains a high pressure helium gas or similar inert gas introduced as a working medium. Furthermore, the compression and expansion sections are connected via a reproducer.

When the Stirling refrigerating machine is operated, the piston is driven by the linear motor to reciprocate periodically as prescribed. The working medium is thus compressed/expanded in a working section (i.e., the compression and expansion sections). The displacer linearly reciprocates as the working medium is compressed/expanded and pressure accordingly varies. Note that the piston and the displacer will reciprocate in the same period with a prescribed phase difference.

The reciprocation results in cold head 6 having cold generated effectively, when heat generated by the compression will be radiated via warm head 7 outside Stirling refrigerating machine 1. The inverted Stirling thermocycle such as a principle of generation of cold as described above is generally well known and accordingly will not be described herein.

Hereinafter a cycle exchanging the heat of the heated portion that includes evaporator 3 and condenser 4 will be described.

As shown in FIG. 1, the present cycle is a natural circulation circuit including evaporator 3 surrounding warm head 7 and utilizing a coolant's evaporation to absorb heat of warm head 7, condenser 4 arranged to be higher than evaporator 3 and condensing the coolant having gas phase, a conduit 8 guiding the coolant from evaporator 3 to condenser 4, and a return pipe 9 returning the coolant in liquid phase from condenser 4 to evaporator 3. Note that the present circuit has water (including an aqueous solution), hydrocarbon or a similar coolant sealed therein. Note that in FIG. 1 evaporator 3 is in the form of an annulus formed of a plurality of (two) portions, i.e., evaporators 3A and 3B.

The annulus may be divided into a plurality of portions other than two portions. Furthermore, evaporator 3 may have an annular geometry other than a circular annulus. It may have any annular geometry (e.g., a square, annular geometry) in accordance with the warm head's geometry.

Furthermore, condenser 4, as shown in FIG. 1, includes a bent pipe 4A, a fin 4B, a header pipe 4C associated with the conduit, and a header pipe 4D associated with the return pipe. Bent pipe 4A connects header pipes 4C and 4D and has fin 4B attached thereto. Furthermore, header pipes 4C, 4D are connected to conduit 8 and return pipe 9, respectively.

The above described heat exchange cycle operates, as described hereinafter.

Warm head 7 generates heat which is in turn transferred to evaporator 3 and evaporates a liquid coolant reserved in evaporator 3. The evaporated coolant's vapor flows from evaporator 3 into conduit 8 and ascends through conduit 8 and thus flows into condenser 4 arranged at a position higher than evaporator 3. Subsequently the gaseous coolant in condenser 4 externally exchanges heat and thus has a major portion thereof condensed.

The coolant condensed in condenser 4 (including the gaseous coolant that has not been condensed) descends through return pipe 9 to evaporator 3 and is again evaporated by heat of warm head 7 and thus exchanges heat.

A conventional heat radiation system for a Stirling refrigerating machine is configured to pass water at and/or blow air to and thus cool a heated portion to facilitate heat radiation.

Utilizing sensible heat of water, air or the like to exchange heat, as described above, however, can only transfer heat in a limited amount, and furthermore, to force water, air or the like to circulate, an external motor or the like is driven, resulting in increased power consumption. Consequently, the heat radiation cycle exchanges heat less efficiently.

In contrast, the present embodiment provides a heat exchange system utilizing latent heat attributed to a coolant's evaporation/condensation to exchange heat. As compared with water/air cooling heat exchange utilizing sensible heat, it can transfer heat in an amount several tens times greater and thus exchange heat more efficiently.

Furthermore the above cycle can obtain natural circulation utilizing a difference in level between evaporator 3 and condenser 4 vertically arranged and a difference in specific gravity between a gas (or the gaseous coolant) and a liquid (or the liquid coolant). This can eliminate the necessity of employing a pump or a similar external force and thus contribute to effective energy conservation.

If the above heat exchange cycle is operated below freezing, the coolant may freeze and thus break or similarly damage a pipe. This can be handled for example by employing a coolant formed of water and an additive containing ethanol, ethylene glycol or the like that are mixed together to have a dropped freezing point and thus be hard to freeze. As a dangerous factor such as combustibility attributed to the additive or the like is considered, the coolant having the additive mixed therewith preferably contains approximately 20% by weight or less of ethanol or ethylene glycol.

Evaporator 3 is structured and attached to Stirling refrigerating machine 1, as will be described hereinafter.

To help to attach evaporator 3 to warm head 7 in the form of a cylinder, evaporator 3 is divided into two semispherical evaporators 3A and 3B combined together to form a generally annular geometry corresponding to the heated portion's geometry in cross section, as shown in FIG. 1. Furthermore, evaporators 3A, 3B each have conduit 8 and return pipe 9 connected thereto.

Evaporator 3 is attached as follows: initially, the pair of semicircular evaporators 3A and 3B is brought to surround and thus closely contact warm head 7, and thus adjoined to form an annulus. Then a single or plurality of bands 10 is used to clamp the evaporator circumferentially. The annular evaporator 3 can thus be brought in close contact with and thus fixed around warm head 7 without a screw, a clamp or the like.

To bring warm head 7 and evaporator 3 into further closer contact with each other to allow the heat radiation cycle to exchange heat more efficiently, heat transferring grease is preferably used.

Condenser 4 condenses and thus liquefies the coolant which in turn flows through return pipe 9 into evaporator 3 and when the coolant again evaporates in evaporator 3 the coolant exchanges heat with warm head 7 (or absorbs heat from warm head 7).

Note that conduit 8 and return pipes 9 are connected to evaporator 3 at a location which the coolant guided through return pipe 9 contacts, i.e., the evaporator's outer peripheral wall at an upper internal surface, or a gaseous coolant area. The liquefied coolant dropping from return pipe 9 located above the evaporator is relatively lower in temperature than the liquid coolant in the evaporator and accordingly has a large cooling ability. The gaseous coolant area is not filled with the coolant in the form of liquid. As such, the gaseous coolant area is higher in temperature than the liquid coolant area, and this heated portion can be cooled by the liquefied coolant dropped from return pipe 9 that has the large cooling ability. The heat radiation cycle can thus provide an increased cooling ability.

Note that the gaseous coolant provided by evaporator 3 flows into conduit 8 at a significantly high rate (for example of approximately 30 m/s) and the condensed, liquefied coolant drops from return pipe 9 into evaporator 3 at a relatively small rate (for example of approximately 9 cc/min). Consequently, the liquefied coolant flowing into evaporator 3 can enter conduit 8 in the form of liquid together with the gaseous coolant having the high flow rate. As a result, evaporator 3 can insufficiently receive the liquid coolant and thus have the liquid with a reduced level, and furthermore, the liquefied coolant provided through return pipe 9 can fail to contact the evaporator's gaseous coolant area, resulting in an impaired cooling function.

Figure 2:
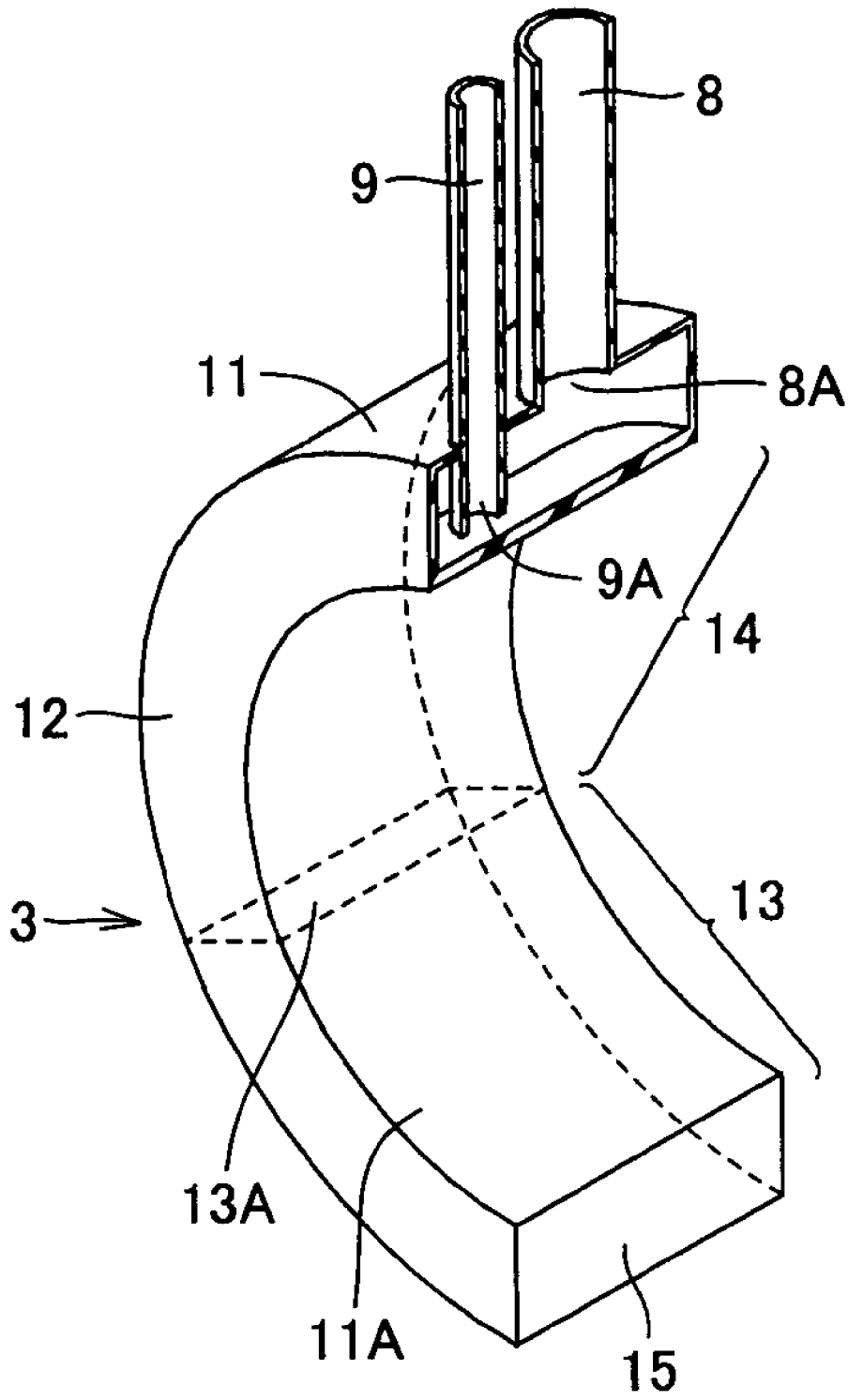
FIG. 2 is a perspective cross section of an evaporator in the present heat exchange system in the first embodiment.
Figure 3:
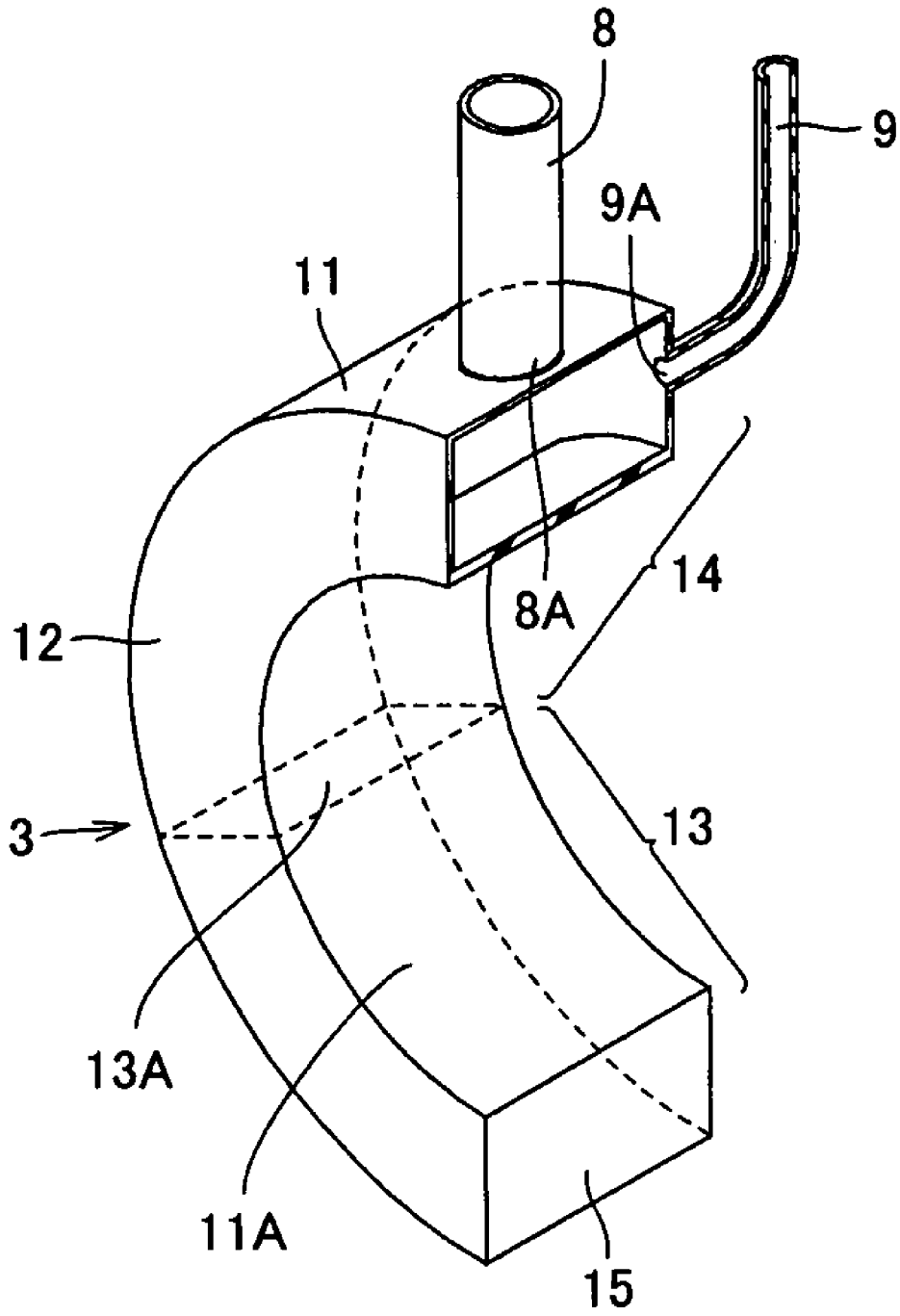
FIG. 3 is a perspective cross section of an exemplary variation of the evaporator in the present heat exchange system in the first embodiment.

In contrast, in the present heat exchange system, as shown for example in FIG. 2 or 3, in evaporator 3 the distance between an opening 9A of return pipe 9 and an inner circumferential surface 11A of evaporator 3 is smaller than that between an opening 8A or conduit 8 and inner circumferential surface 11A. Note that the distances indicate distances connecting openings 8A and 9A, respectively, and inner circumferential surface 11A by straight line.

Evaporator 3 most actively exchanges heat at a portion contacting warm head 7, i.e., at its inner circumferential surface. As has been described above, return pipe 9 having an opening closer to inner circumferential surface 11A can help the liquefied coolant flowing into evaporator 3 to reach the inner circumferential surface of evaporator 3 so as to prevent the liquefied coolant from flowing into conduit 8 in the form of liquid contributing to an impaired cooling function.

Conduit 8 and return pipe 9 are structured, as described more specifically hereinafter.

Conduit 8 and return pipe 9 are structured, by way of example, as shown in FIG. 2. More specifically, conduit 8 and return pipe 9 are connected to evaporate 3 at an outer circumferential surface 11, and return pipe 9 protrudes to be closer to inner circumferential surface 11A than conduit 8. Preferably, return pipe 9 has an end spaced from inner circumferential surface 11A by approximately 3 mm. If the end is too close to inner circumferential surface 11A it provides disadvantageous resistance against flowability.

Alternatively, as shown in FIG. 3, conduit 8 may be connected to evaporator 3 at outer circumferential surface 11 and return pipe 9 may be connected to evaporator 3 at an axial end surface 12.

Thus the present heat exchange system can address the entire device's structural constraint by being capable of selecting from a plurality of variations in structure of conduit and return pipe 9 connected to evaporator 3.

Note that if return pipe 9 is connected to evaporator 3 at axial end surface 12, return pipe 9 is preferably connected to evaporator 3 at end surface 12 axially opposite to cold head 6 serving as the heat absorbing portion (see FIG. 1).

This can prevent cold head 6 from receiving heat transferred from the coolant, which has a relatively high temperature, and thus increasing cold head 6 in temperature, and thus exchange heat of the Stirling refrigerating machine more efficiently.

When the above Stirling refrigerating machine and heat exchange system are activated, as shown in FIGS. 2 and 3, evaporator 3 internally has a liquid coolant area 13 and an evaporated or gaseous coolant area 14 at lower and upper portions, respectively, with a liquid surface 13A as a border. Preferably, return pipe 9 is connected to evaporator 3 in gaseous coolant region 14 closer to an end surface 15 of the sub evaporator that traverses the sub evaporator's circumferential direction than conduit 8. (Note that end surface 15 is that closer to conduit 8. In FIGS. 2 and 3, this end surface is not shown as it is cut for the sake of illustration.)

Thus the liquefied coolant flowing through return pipe 9 into the evaporator 3 can less be entangled with a stream of the gas flowing from evaporator 3 into conduit 8. This can prevent evaporator 3 from insufficiently receiving the liquefied coolant and the heat radiation cycle from having an impaired cooling function.

Figure 4:
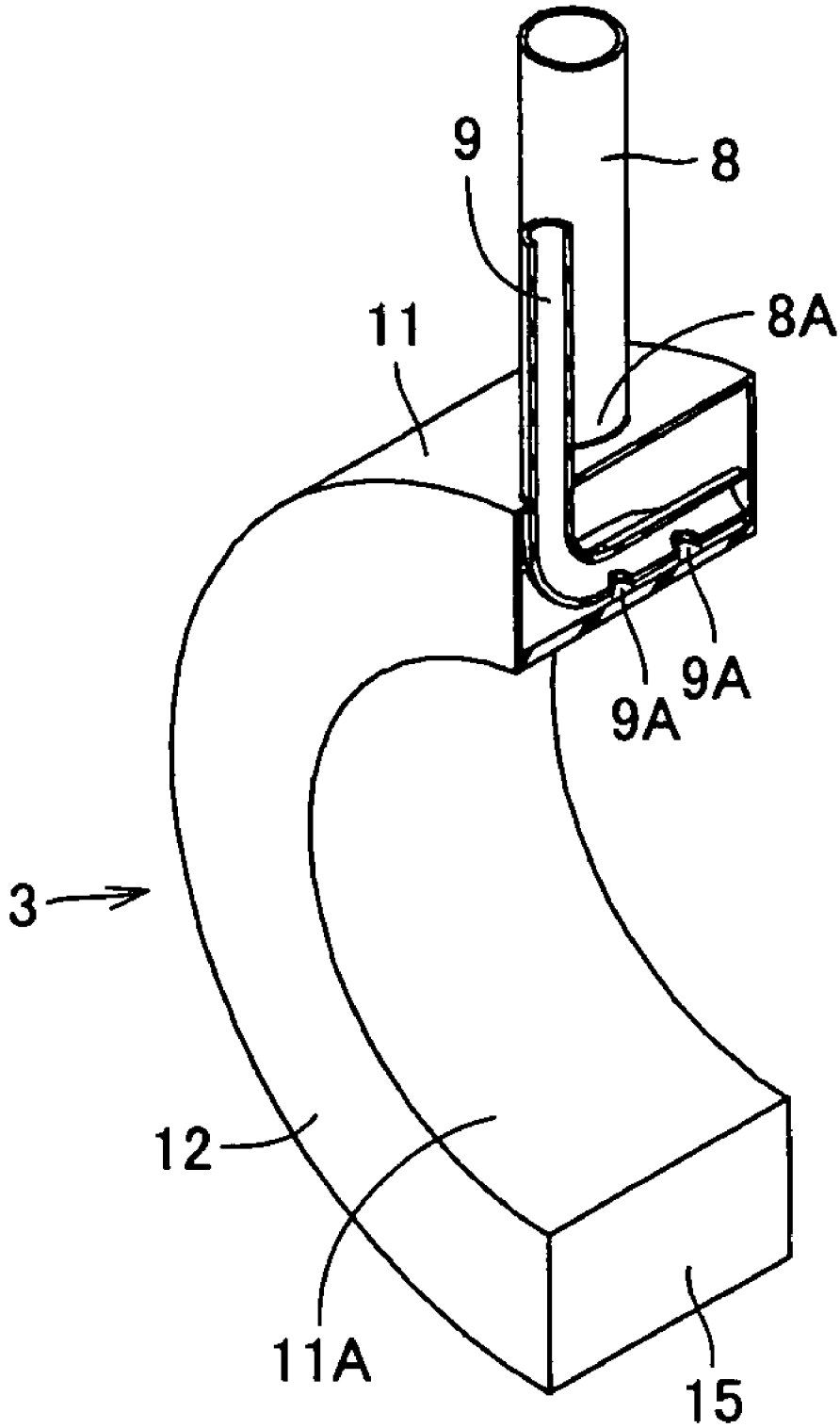
FIG. 4 is a perspective cross section of an evaporator in the present heat exchange system in the first embodiment with a return pipe extending in a direction traversing an axial end surface.
Figure 5:
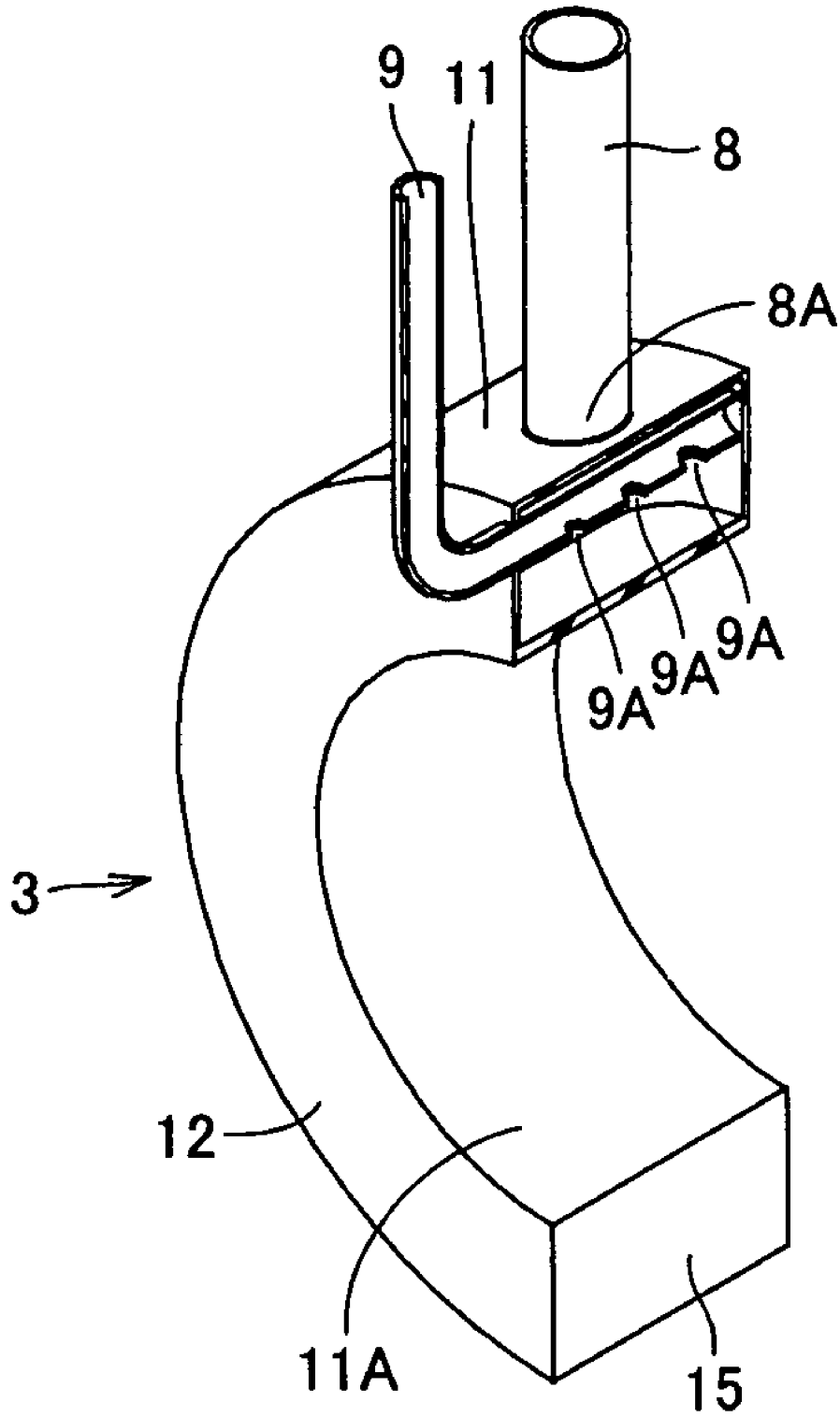
FIG. 5 is a perspective cross section of an exemplary variation of the evaporator in the present heat exchange system in the first embodiment with a return pipe extending in the direction traversing the axial end surface.

Furthermore, as shown in FIG. 4, return pipe 9 may be connected at outer circumferential surface 11 and bent in evaporator 3 to extend in a direction traversing axial end surface 12, or, as shown in FIG. 5, may be bent external to evaporator 3 and connected at axial end surface 12, and also extend in evaporator 3 in a direction traversing axial end surface 12.

Note that while as shown in FIGS. 4 and 5 return pipes 9 extends substantially across evaporator 3 as seen axially, return pipe 9 may extend only for a portion of the evaporator.

Return pipe 9 extending in a direction traversing axial end surface 12 allows evaporator 3 to have an external structure similar to those of FIGS. 2 and 3 and also have opening 9A therein at any axial position. This can help to drop the liquefied coolant at a location preventing the liquefied coolant from being entangled with a stream of gas flowing into conduit 8, and hence effectively prevent the liquefied coolant from flowing back into conduit 8.

Furthermore in this example return pipe 9 preferably has a plurality of openings 9A in evaporator 3, as shown in FIGS. 4 and 5.

This allows the condensed, liquefied coolant to disperse and thus drop in evaporator 3 axially. The liquefied coolant can be brought into contact with inner circumferential surface 11A over an increased area to enhance the heat radiation cycle's cooling effect.

Furthermore the plurality of openings 9A preferably has a diameter increased downstream than upstream of return pipe 9. The liquefied coolant can also be readily dropped in return pipe 9 downstream having a large resistance of fluid to flow. Openings 9A can thus drop the liquefied coolant in amounts, respectively, in balance.

Figure 6:
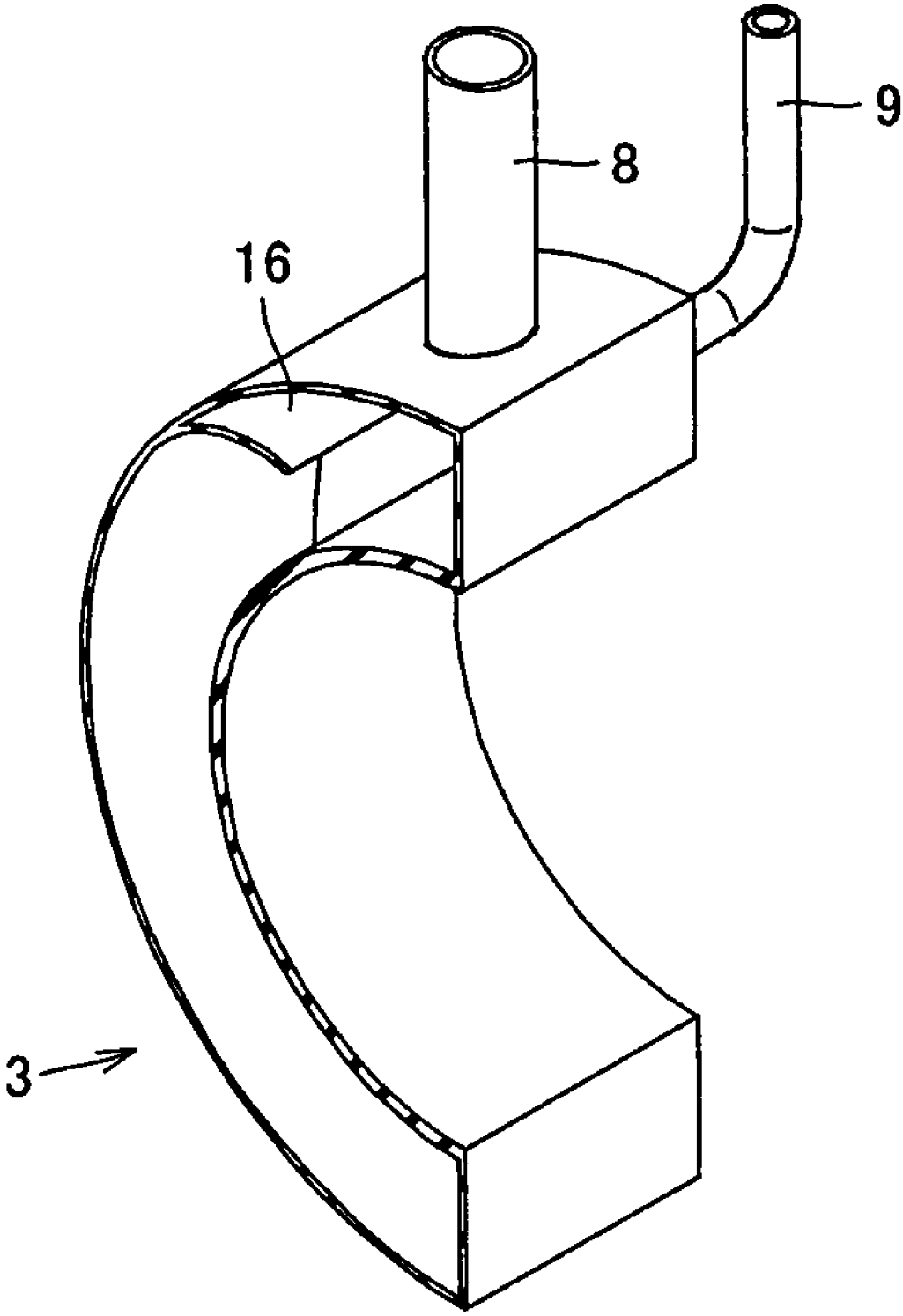

Evaporator 3 in an exemplary variation, as shown in FIG. 6, can have a structure provided with a plate 16 underlying opening 8A of conduit 8 to prevent the liquefied coolant from flowing into conduit 8.

When evaporator 3 has the coolant evaporated therein, the coolant can provide a significantly large bubble. As the bubble ascends, the liquid coolant area has the liquid coolant accordingly lifted up and scattered. As a result, a portion of the scattered liquid coolant can flow into conduit 8 in the form of liquid. This phenomenon contributes to a reduced amount of the liquid coolant in evaporator 3 and hence an impaired cooling ability. In the exemplary variation, plate 16 can act to prevent the phenomenon and hence an impaired cooling function.

Figure 7:
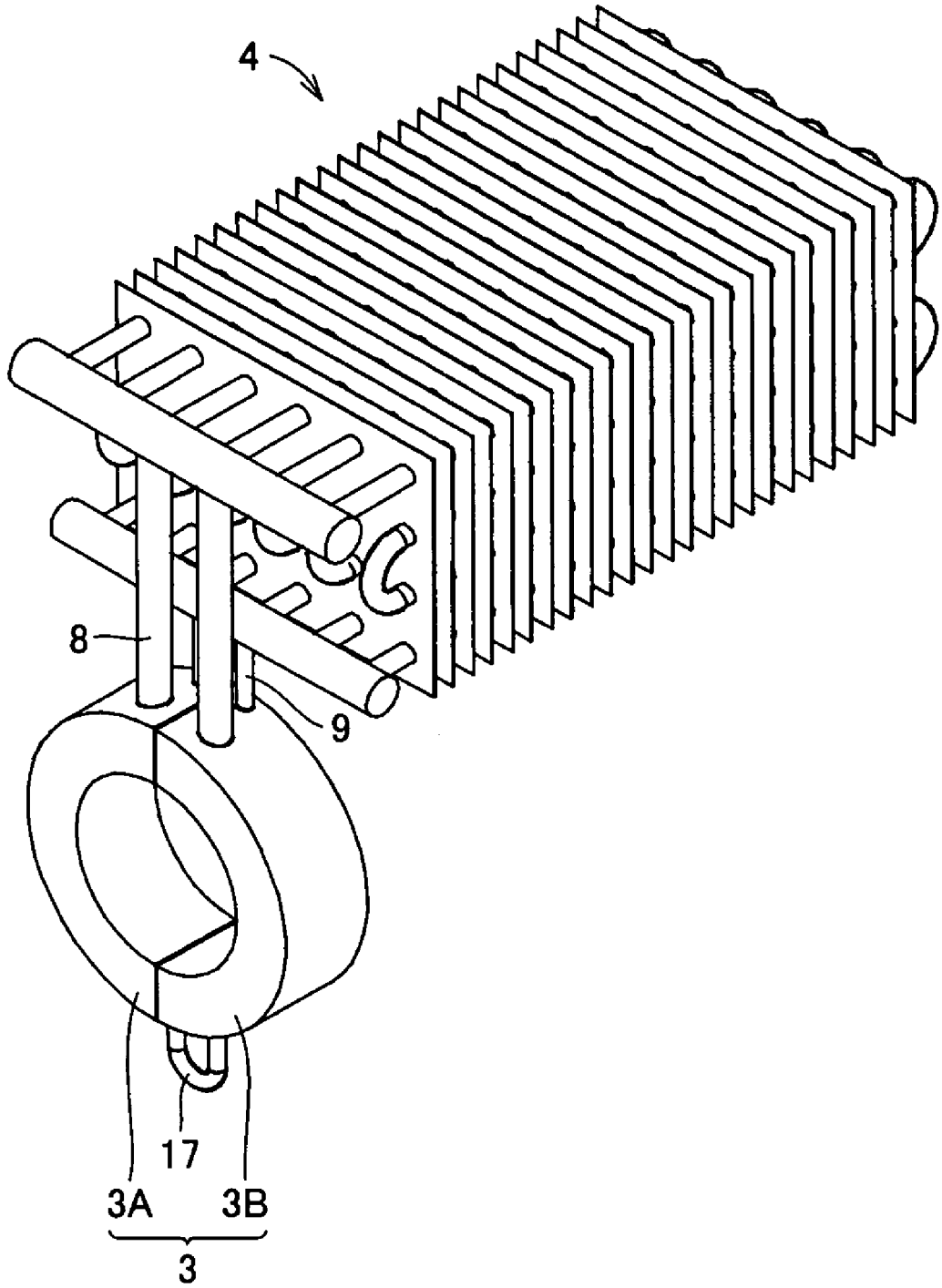
FIG. 7 is a perspective view of the present heat exchange system in the first embodiment including an evaporator having a connection pipe.

Furthermore, evaporator 3 in another exemplary variation, as shown in FIG. 7, can have a structure provided with a connection pipe 17 apart from return pipe 9 and connected to evaporator 3 at a plurality of portions, respectively, to connect the portions to allow the portions to communicate the liquid coolant.

Thus the plurality of (two in FIG. 7) evaporators 3 can have different levels of a coolant adjusted. Each evaporator 3 can have a limited reduction in liquid level. As a result the heat radiation cycle can be prevented from having an impaired cooling function.

Figure 8:
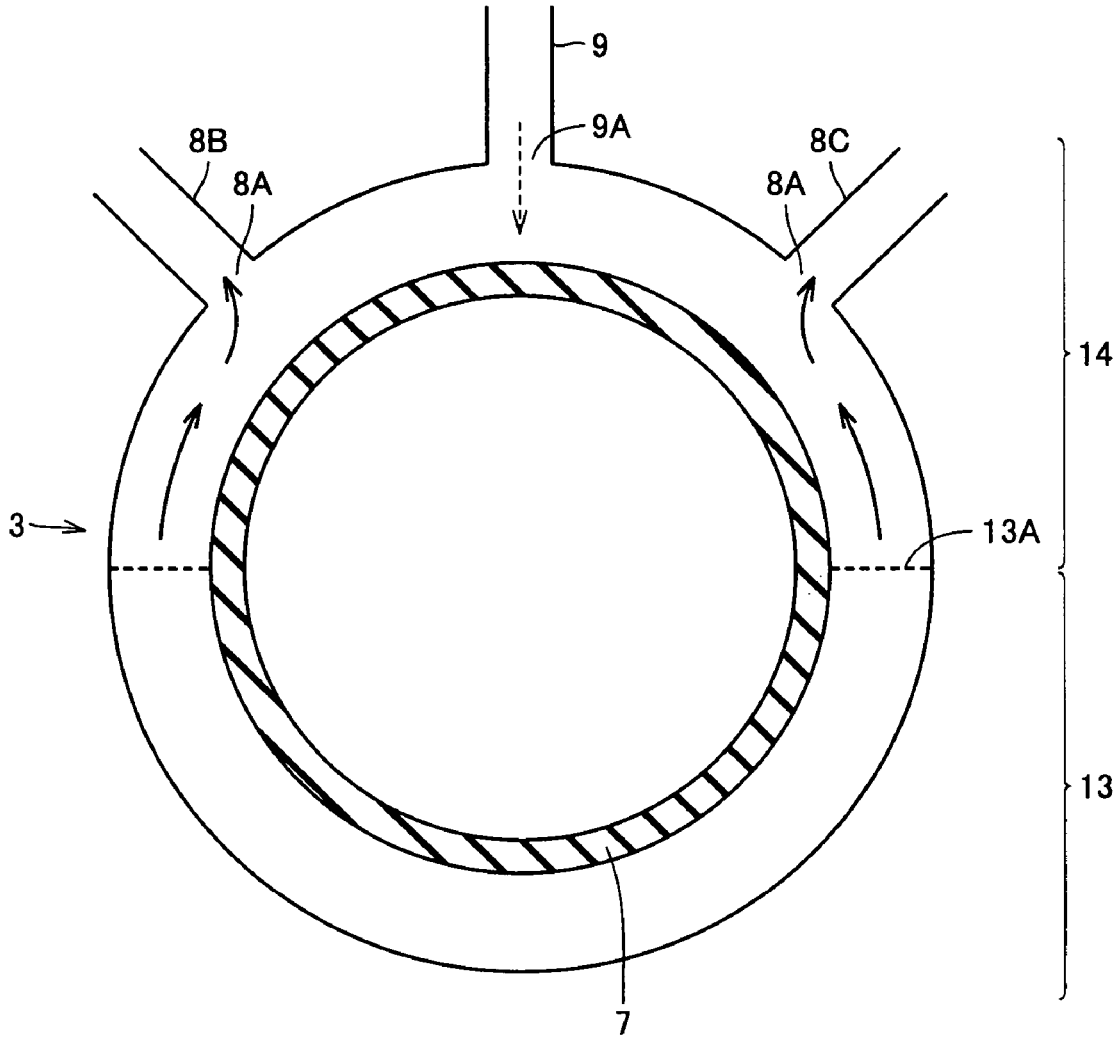
FIG. 8 schematically shows another exemplary variation of the evaporator in the present heat exchange system in the first embodiment.

Note that in the present heat exchange system evaporator 3 is not limited to that divided into a plurality of portions. For example, it may have an annular geometry, as shown in FIG. 8. In that case, preferably evaporator 3 has first and second conduits 8B and 8C connected thereto and, as shown in FIG. 8, evaporator 3 has return pipe 9 connected thereto between locations at which conduits 8B and 8C, respectively, are connected to evaporator 3.

Thus the condensed, liquefied coolant dropping through return pipe 9 into evaporator 3, as indicated in FIG. 8 by a broken arrow, can less be entangled with a stream caused by the coolant evaporated from liquid surface 13A and flowing into conduit 8, as indicated in FIG. 8 by a solid arrow. As the coolant less flows back into conduit 8, evaporator 3 can be prevented from having a reduced liquid level and as a result the heat radiation cycle can be prevented from having an impaired cooling function.

Figure 9:
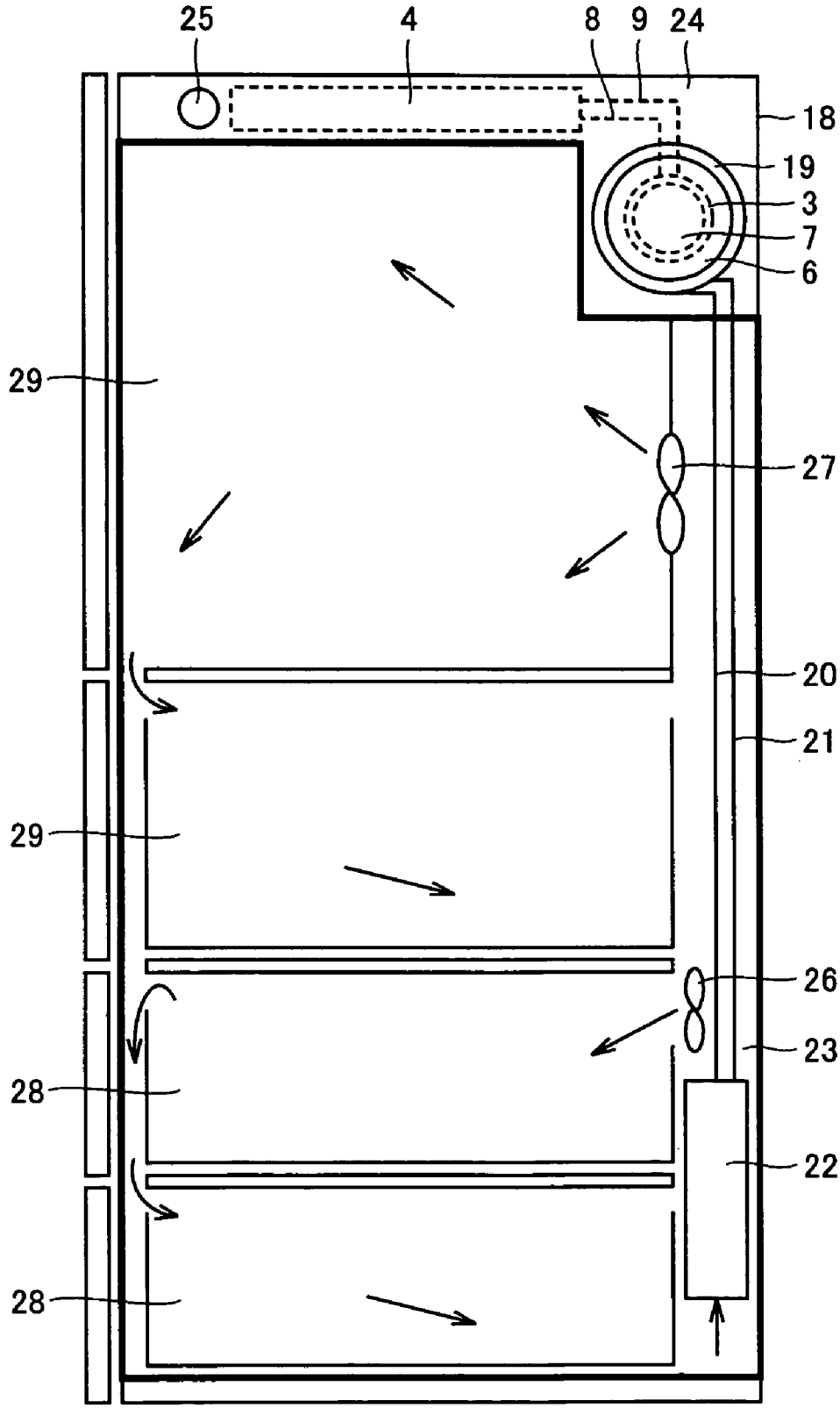
FIG. 9 is a side cross section of a Stirling refrigerator equipped with the present heat exchange system in the first embodiment.

FIG. 9 shows one example of Stirling refrigerator including a Stirling refrigerating machine having the heat exchange system as described above.

FIG. 9 shows a refrigerator 18 including at least one of a freezer section and a chiller section as a refrigeration section. Furthermore, refrigerator 18 includes the above described heat exchange system (indicated in FIG. 9 by a broken line) as a heat transfer cycle (or a heat radiation system) associated with a heated portion and cooling a warm head of the Stirling refrigerating machine, and also includes a heat transfer cycle (or a heat absorption system) associated with a cold portion and exchanging heat between inside the refrigerator and a cold head of the Stirling refrigerating machine.

The heat transfer cycle associated with the cold portion is a circulation circuit including a condenser 19 associated with the cold portion and attached around and in contact with cold head 6 (see FIG. 1), and an evaporator 22 associated with the cold portion and connected to condenser 19 via a return pipe 20 associated with the cold portion and a conduit 21 associated with the cold portion. This circuit has carbon dioxide, hydrocarbon or the like sealed therein as a coolant. To allow the coolant's evaporation and condensation and resultant natural circulation to be utilized to transfer cold generated at cold head 6, evaporator 22 is arranged to be lower than condenser 19.

As shown in FIG. 9, the Stirling refrigerating machine is arranged in refrigerator 18 at a rear, upper portion. Furthermore, the heat absorption system is arranged in refrigerator 18 closer to the rear side and the heat radiation system is arranged in refrigerator 18 at an upper portion. Note that evaporator 22 is provided in a cold duct 23 provided in refrigerator 18 at a rear portion and condenser 4 is provided in a duct 24 provided in refrigerator 18 at an upper portion.

When Stirling refrigerating machine 1 is operated, warm head 7 (see FIG. 1) generates heat, which is thermally exchanged via condenser 4 with air present in duct 24. An air blowing fan 25 exhausts warm air present in duct 24 external to refrigerator 18 and also takes in air external to refrigerator 18 to help to exchange heat.

In contrast, cold head 6 generates cold, which is thermally exchanged via evaporator 22 with a stream present in cold duct 23, as indicated in FIG. 9 by an arrow. A fan 26 associated with the freezer section and a fan 27 associated with the chiller section blow toward freezer section 28 and chiller section 29, respectively, the cool provided via evaporator 22. Each refrigeration section 28, 29 provides a warm stream which is again sent through cold duct 23 to evaporator 22 and repeatedly cooled.

The Stirling refrigerating machine provided to refrigerator 18 that has the above described structure can have a heat radiation cycle having an enhanced cooling function and as a result the refrigerator can have an improved coefficient of performance.

The present heat exchange system is applicable not only to the above described Stirling refrigerating machine but also any device having a heat source similar in geometry. More specifically, it may for example be applied to cooling a thyrister used for example in electric trains, a molding die, and the like.

Note that in the above described heat exchange system the above described features are originally intended to be combined together to provide a composite effect.

Second Embodiment

The present embodiment provides a heat radiation system adopting a loop thermosyphon to externally radiate heat generated at a Stirling refrigerating machine. More specifically in the present radiation system the Stirling refrigerating machine has a compression section serving as a heat source, and heat generated at the compression section is recovered via a heat radiating portion, which is provided to the Stirling refrigerating machine, to an evaporator of the loop thermosyphon and a working fluid in the evaporator serves as a medium transferring heat to a condenser to externally radiate heat.

Figure 10:
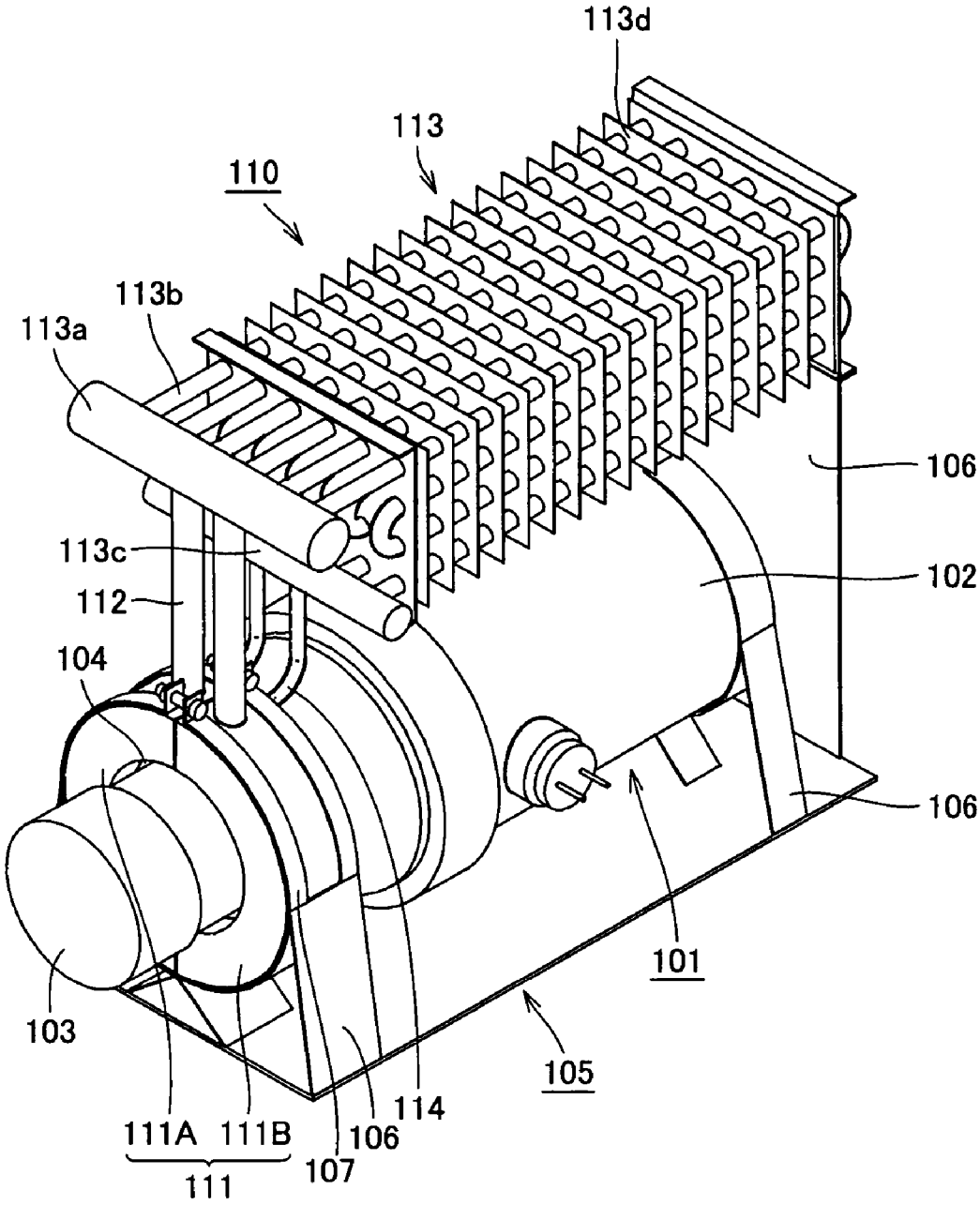
FIG. 10 is a schematic perspective view of a Stirling refrigerating machine equipped with a loop thermosyphon of the present invention in a second embodiment.

FIG. 10 is a schematic perspective view of a Stirling refrigerating machine including a loop thermosyphon in the second embodiment. Initially with reference to FIG. 10 will be described the loop thermosyphon and a structure applied to install the Stirling refrigerating machine having the loop thermosyphon attached thereto.

As shown in FIG. 10, a Stirling refrigerating machine 101 is placed on a supporting platform 105 and supported by a supporting portion 106 provided at a bottom plate of supporting platform 105, and so is loop thermosyphon 110. Note that loop thermosyphon 110 includes an evaporator 111, as described hereinafter, fixed to a heat radiation portion 104 of Stirling refrigerating machine 101 by a clamping band 107. Stirling refrigerating machine 101 and loop thermosyphon 110 thus supported on supporting platform 105 is arranged in a casing for example of prescribed equipment such as a refrigerator.

Stirling refrigerating machine 101 has a structure and operates, as described hereinafter.

As shown in FIG. 10, Stirling refrigerating machine 101 includes a pressure chamber 102 internally provided with a cylinder having a piston and a displacer fitted therein, with helium or a similar working medium introduced therein. The cylinder has an internal space segmented by the piston and the displacer into a compression section and an expansion section. The compression section is surrounded by a heat radiating portion (or warm head) 104 and the expansion section is surrounded by a heat absorbing portion (or cold head) 103.

The piston fitted in the cylinder is driven by a linear actuator to reciprocate in the cylinder. As the piston reciprocates and pressure accordingly varies, the displacer reciprocates in the cylinder with a constant phase difference from the piston's reciprocation. As the piston and the displacer reciprocate, an inverted Stirling cycle is implemented in the cylinder. Thus heat radiating portion 104 surrounding the compression section rises in temperature and heat absorbing portion 103 surrounding the expansion section is cooled to cryogenic temperature.

Loop thermosyphon 110 has a structure and operates as described hereinafter.

As shown in FIG. 10, loop thermosyphon 110 includes evaporator 111 and a condenser 113. Evaporator 111 is arranged in contact with heat radiating portion 104 of Stirling refrigerating machine 101 to deprive heat radiating portion 104 of heat to evaporate a working fluid introduced in evaporator 111. Condenser 113 is arranged at a position higher than evaporator 111 to condense the working fluid evaporated at evaporator 111. Evaporator 111 and condenser 113 are connected by a feed pipe 112 and a return pipe 114 to together form a closed circuit. Note that in loop thermosyphon 110 as shown in the figure a heat source, or heat radiating portion 104, has a cylindrical geometry. Accordingly, evaporator 111 is formed of two arcuate components, or evaporators 111A and 111B.

Condenser 113 a header pipe 113*a* associated with the feed pipe, a header pipe 113*c* associated with the return pipe, a plurality of parallel pipes 113*b*-connecting headers 113*a* and 113*c*, and a heat radiating fin 113 provided in contact with parallel pipes 113*b*, assembled together to be a unit.

Header pipe 113*a* is a distributor connected to feed pipe 112 to branch the working fluid introduced. In contrast, header pipe 113*c* is connected to return pipe 114 to collect pipes to join the branches of the working fluid together.

In evaporator 111 the working fluid deprives heat radiating portion 104 of Stirling refrigerating machine 101 of heat and thus evaporates, and ascends by a vapor pressure difference between evaporator 111 and condenser 113 against gravity through feed pipe 112 and enters condenser 113. Condenser 113 cools and thus condenses the working fluid, which is in turn pulled by gravity, and thus descends through return pipe 114 and enters evaporator 111. Such convection of the working fluid involving a change in phase as described above allows heat radiating portion 104 to externally radiate heat.

Figure 11:
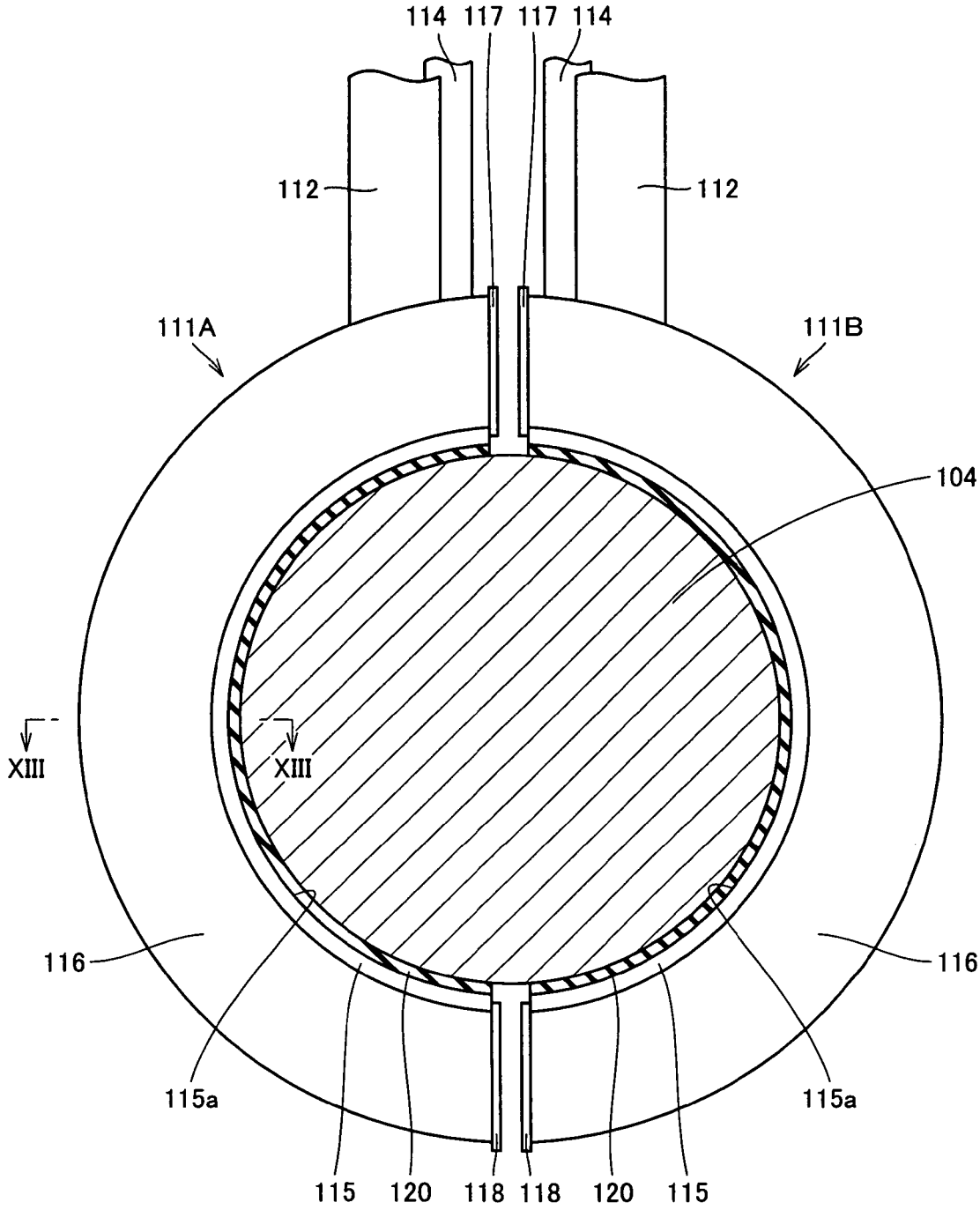
FIG. 11 shows an end surface of an evaporator arranged to surround a heat radiating portion of a Stirling refrigerating machine.
Figure 12:
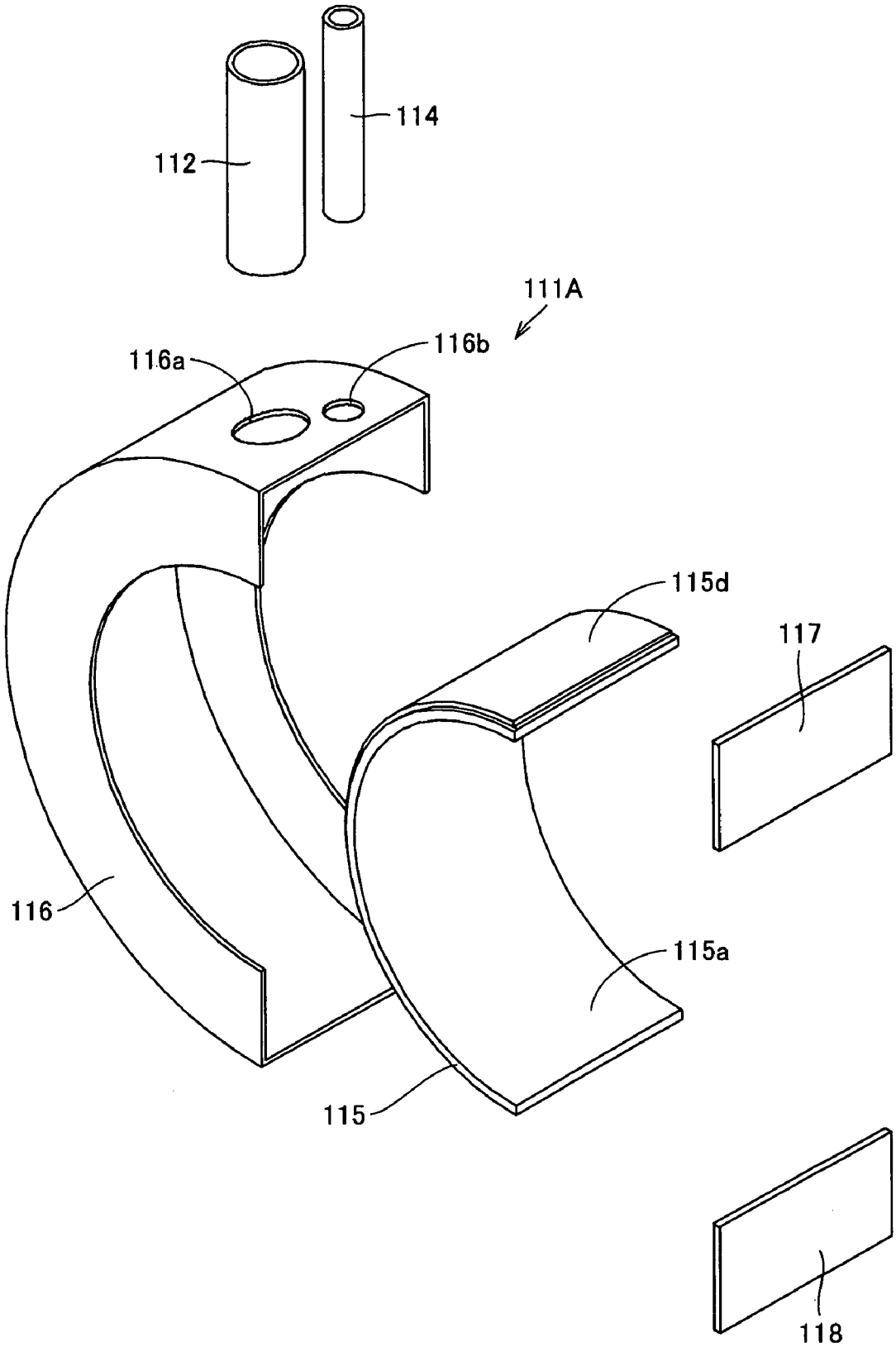
FIG. 12 is an exploded perspective view of a structure of an evaporator before it is assembled.

FIG. 11 shows an evaporator arranged to surround a heat radiating portion of a Stirling refrigerating machine, as seen at an end surface. FIG. 12 shows the evaporator disassembled as seen in an exploded perspective view. Hereinafter these figures will be referenced to more specifically describe the evaporator's structure.

As shown in FIG. 11, evaporator 111 is configured of two semi-annular segments, or evaporators 111A and 111B , to be attachable in close contact with an outer peripheral surface of heat radiating portion 104 having a cylindrical geometry. More specifically, evaporators 111A and 111B assembled provide a generally annular geometry. Evaporators 111A and 111B each have an upper portion with feed pipe 112 and return pipe 114 connected thereto.

Between heat radiating portion 104 and evaporators 111A and 111B a highly heat conductive grease 120 is posed. Grease 120 is applied to allow heat radiating portion 104 and evaporators 111A and 111B to have close contact therebetween. Grease 120 is introduced into a gap between heat radiating portion 104 and evaporators. 111A and 111B to allow heat generated at heat radiating portion 104 to be transferred to evaporators 111A and 111B efficiently. Note that in the present specification not only a heat radiating portion and an evaporator directly contacting each other but also those indirectly contacting with each other via a heat radiating grease or a similar heat transferring material, as described in the present embodiment, will be represented as those "abutting against each other".

As shown in FIGS. 11 and 12, evaporators 111A and 111B are formed sub frames, respectively. The sub frame is formed of an inner frame 115 including a surface 115A abutting against heat radiating portion 104, an outer frame 116 which does not abut against heat radiating portion 104, and caps 117 and 118 closing an opening provided at a radial end of evaporators 111A and 111B when inner and outer frames 115 and 116 are assembled. The sub frames are welded with a brazing material and thus connected together. Note that outer frame 116 has an outer circumferential surface having holes 116*a* and 116*b* allowing feed and return pipes 112 and 114 to be connected to the interior of evaporators 111A and 111B after assembly and at a position corresponding to holes 116*a* and 116*b* feed and return pipes 112 and 114 are welded and thus connected.

Evaporators 111A and 111B thus configured form therein a path capable of passing a working fluid. Evaporators 111A and 111B have the working fluid sealed therein, such as a coolant formed of water with an additive containing ethanol, ethylene glycol, or the like mixed together.

Figure 13:
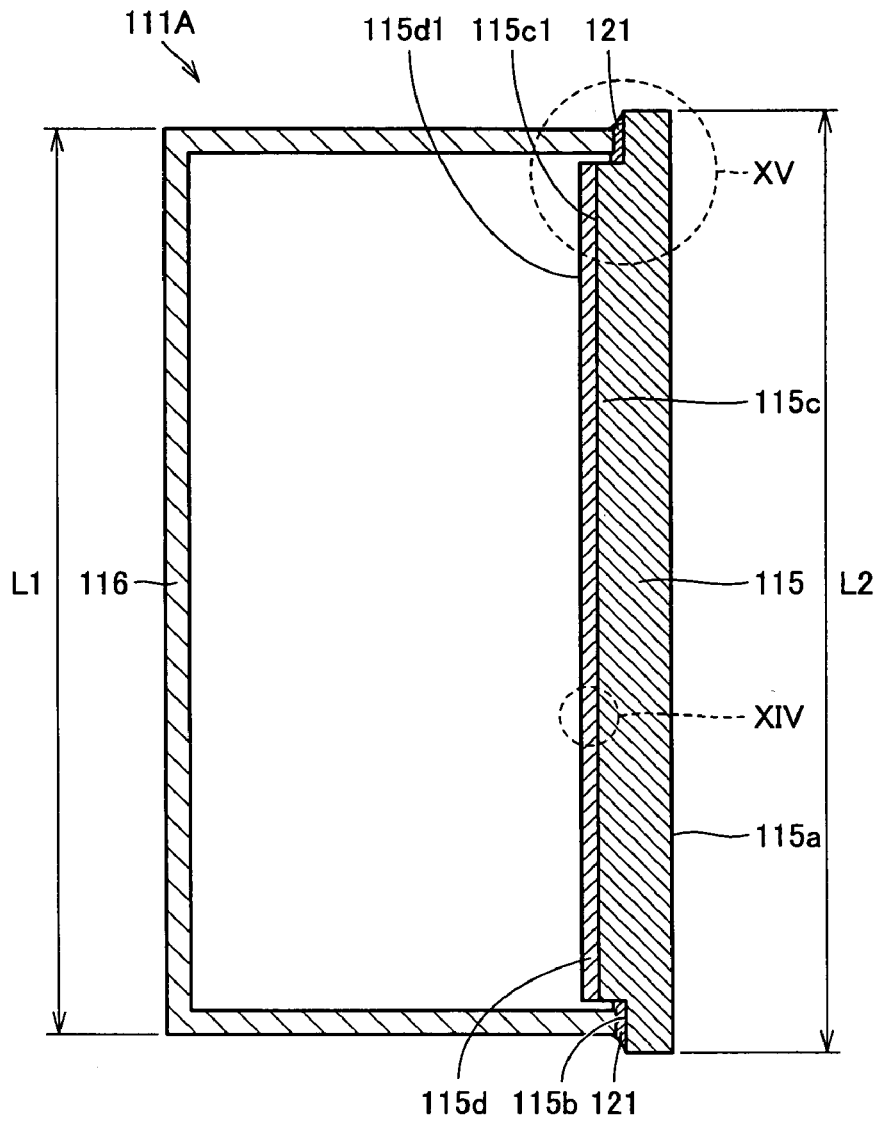
FIG. 13 is a cross section of the evaporator taken along the line XIII-XIII shown in FIG. 11.
Figure 14:
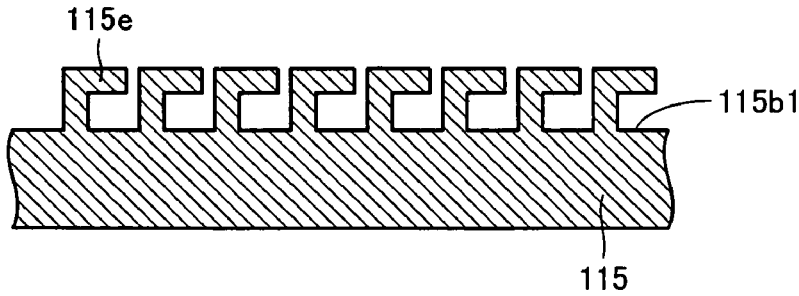
FIG. 14 is an enlarged cross section of a portion XIV shown in FIG. 13.

FIG. 13 is a cross section of the evaporator taken along a line VIII-VIII indicated in FIG. 11. Furthermore, FIG. 14 is an enlarged cross section of a portion XIV shown in FIG. 13. Hereinafter these figures will be referenced to describe the evaporator's internal structure.

As shown in FIG. 13, evaporator 111A has inner and outer frames 115 and 116 connected at their respective connecting portions with a brazing material 121. Inner frame 15 has opposite to surface 115*a* an internal wall surface 115*b* provided with a plateau 115*c* protruding toward the flow path. Plateau 115*c* has a top surface 115*c*1 previously roughened to provide a processed surface 115*d*.

More specifically, roughening as referred to herein means providing a surface with small recesses and protrusions. For example, a cutting tool is employed to cut and thus raise inner frame 115 at internal wall surface 115*b* to provide internal wall surface 115*b* with an indefinite number of protrusions 115*e* which are in turn rolled to have their respective ends bent. Such roughening can provide inner frame 15 at a portion facing the working fluid, or internal wall surface 115*b*, with the indefinite number of protrusions 115*e* to ensure that the frames forming evaporators 111A and 111B contact the working fluid over an increased area. This allows facilitated heat exchange so that evaporators 111A and 111B can be improved in performance in cooling the heated portion. Furthermore, protrusions 115*e* raised as described above that are also bent can help to form cores of bubbles in spaces surrounded by protrusions 115*e*. This can help to evaporate the working fluid to further enhance the evaporator's performance in cooling the heated portion.

Thus, as described in the present embodiment, an internal wall surface that is roughened of a portion abutting against a heat radiating portion of an evaporator of a loop thermosyphon allows heat transferred from the heat radiating portion to the evaporator's frame to efficiently be utilized to evaporate a working fluid. The loop thermosyphon can thus cool a heated portion efficiently. Furthermore, the evaporator that is divided into a plurality of sub frames allows roughening only a frame having a portion abutting against the heat radiating portion before the evaporator is assembled. The evaporator configured as described above can be readily formed without a cumbersome fabrication process.

If a frame that has an inner frame roughened and is thereafter divided into a plurality is welded with a brazing material and thus connected, however, the roughened and or processed surface tends to be exposed to the material as it readily flows to the surface. To maintain high performance in cooling the heated portion, the inner frame preferably has the portion facing the flow path entirely roughened. In the configuration as described above, however, the brazing material is readily sucked between the recesses and protrusions of the processed surface and as a result would massively flow into the evaporator, resulting in poor performance in cooling the heated portion. Accordingly the present embodiment provides a loop thermosyphon including an evaporator having an inner frame with an internal wall surface provided with a plateau having a top surface roughened to overcome the above disadvantage. Hereinafter this feature will be more specifically described with reference to the drawings.

As shown in FIG. 13, as seen in the axial direction of evaporator 111A, outer frame 116 has a geometrical dimension L1 smaller than a geometrical dimension L2 of inner frame 115. As such, inner frame 115 after assembly will have an end protruding as compared with outer frame 116, as seen in the axial direction of evaporator 111A.

Figure 15:
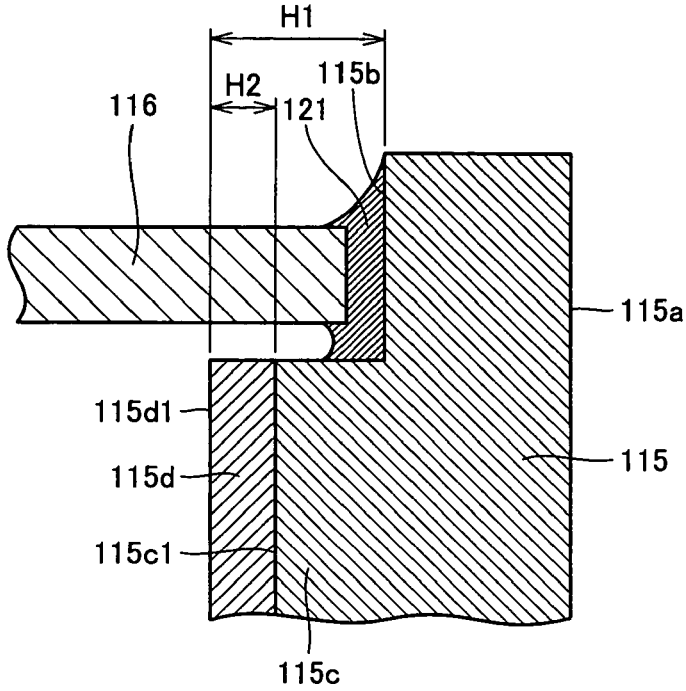
FIG. 15 is an enlarged cross section of a portion XV shown in FIG. 13.

FIG. 15 is an enlarged cross section of a portion XV in FIG. 13. Inner frame 115 at internal wall surface 115*b* in a vicinity of the end as seen in the axial direction of evaporator 111A, has a step resulting from plateau 115*c*, and in assembly, an edge of outer frame 116 is fitted into the step and brazed. Note that a thickness H2 of processed surface 115*d* located at top surface 115*c*1 of plateau 115*c* is smaller than a distance H1 from the processed surface's top surface 115*d*1 to internal wall surface 115*b* corresponding to the step's bottom surface.

Inner and outer frames 115 and 116 formed to have such geometry ensures a large distance to processed surface 115*d* from a location having the brazing material placed to weld inner and outer frames 115 and 116 together. This can prevent brazing material 121 from flowing into evaporator 111A and being sucked by processed surface 115*d*. Impaired performance in cooling the heated portion can thus be prevented.

Furthermore, as shown in FIG. 11, the present embodiment provides loop thermosyphon 110 including evaporator 111 configured of a semi-annular segments or two evaporators 111A and 111B and having a geometry assembled at an outer peripheral surface of heat radiating portion 104 having a cylindrical geometry. As such, in welding and thus attaching caps 1117 and 118 to inner and outer frames 115 and 116 having been welded together, the caps must carefully be welded such that the brazing material does not protrude toward surface 115*a* of inner frame 115 or on the cap's surface. If the brazing material protrudes at such locations it may impair the radiator and evaporator's close contact and hence loop thermosyphon 110 in performance in cooling the heated portion. Accordingly in the present embodiment loop thermosyphon 110 can have a cap attached at a position to overcome this disadvantage. Hereinafter this will be more specifically described with reference to the drawings.

Figure 16:
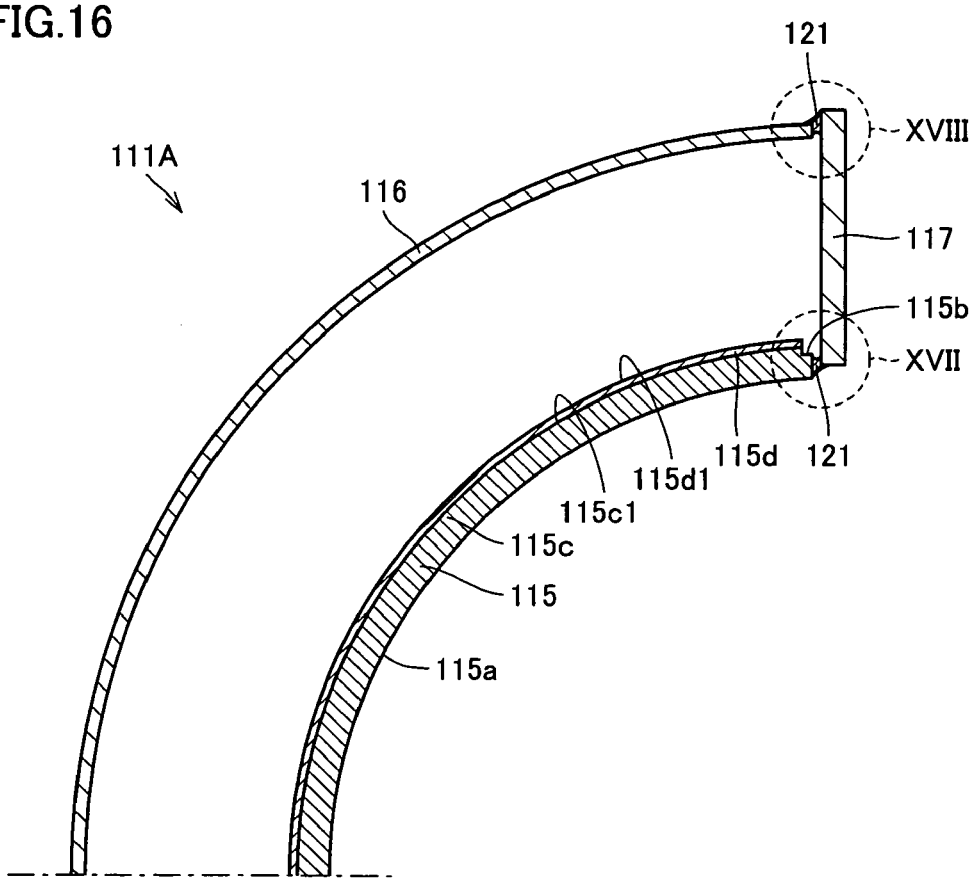
FIG. 16 is a cross section of the evaporator as seen in a plane orthogonal to the evaporator's axial line.
Figure 17:
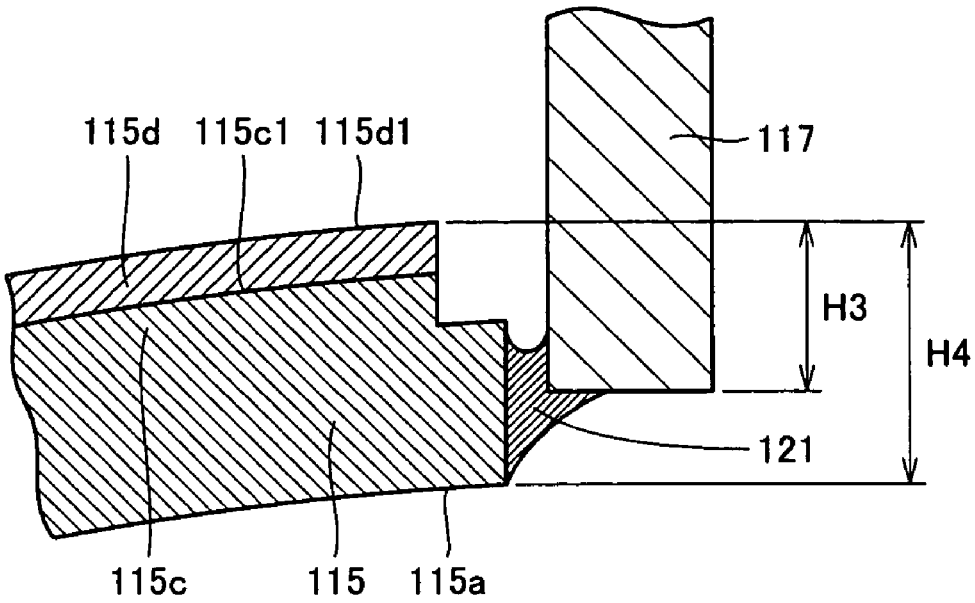
FIG. 17 is an enlarged view of a portion XVII shown in FIG. 16.

FIG. 16 is a cross section of the evaporator in a plane orthogonal to the evaporator's axial line. Furthermore, FIG. 17 is an enlarged view of a portion XVII shown in FIG. 16 and dig 18 is an enlarged view of a portion XVIII shown in FIG. 16.

Figure 18:
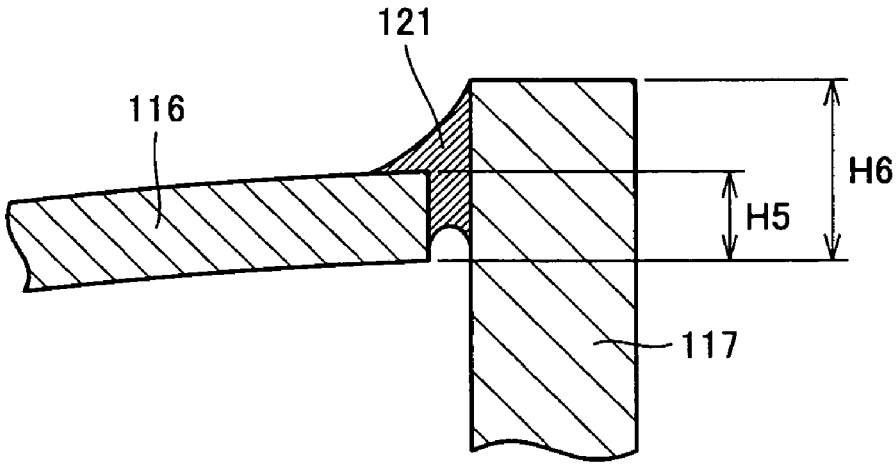
FIG. 18 is an enlarged view of a portion XVIII shown in FIG. 16.

As shown in FIG. 16, cap 117 closing an opening provided at a radial end of inner and outer frames 115 and 116 having been welded together is attached at a position slightly offset toward an outer side, as seen in the radial direction of evaporator 111A. More specifically, as shown in FIG. 17, at portion XVII, cap 117 is attached such that a distance H3 from top surface 115*d* of inner frame 115 to an end of cap 117 is smaller than a distance H4 from top surface 115*d*1 of processed surface 115*d* of inner frame 115 to surface 115*a* of inner frame 115. Furthermore, as shown in FIG. 18, at portion XVIII, cap 117 is attached such that a distance H6 from the internal wall surface of the inner frame to an end of cap 17 is greater than a thickness H5 of outer frame 116.

Attaching cap 117 to inner and outer frames 115 and 116 having been welded together such that the cap is slightly offset, can eliminate the possibility of the brazing material protruding toward surface 115*a* of inner frame 115 or on a surface of cap 117. Thus the radiator and the evaporator can achieve significantly close contact therebetween and the loop thermosyphon can maintain high performance in cooling the heated portion.

Third Embodiment

Figure 19:
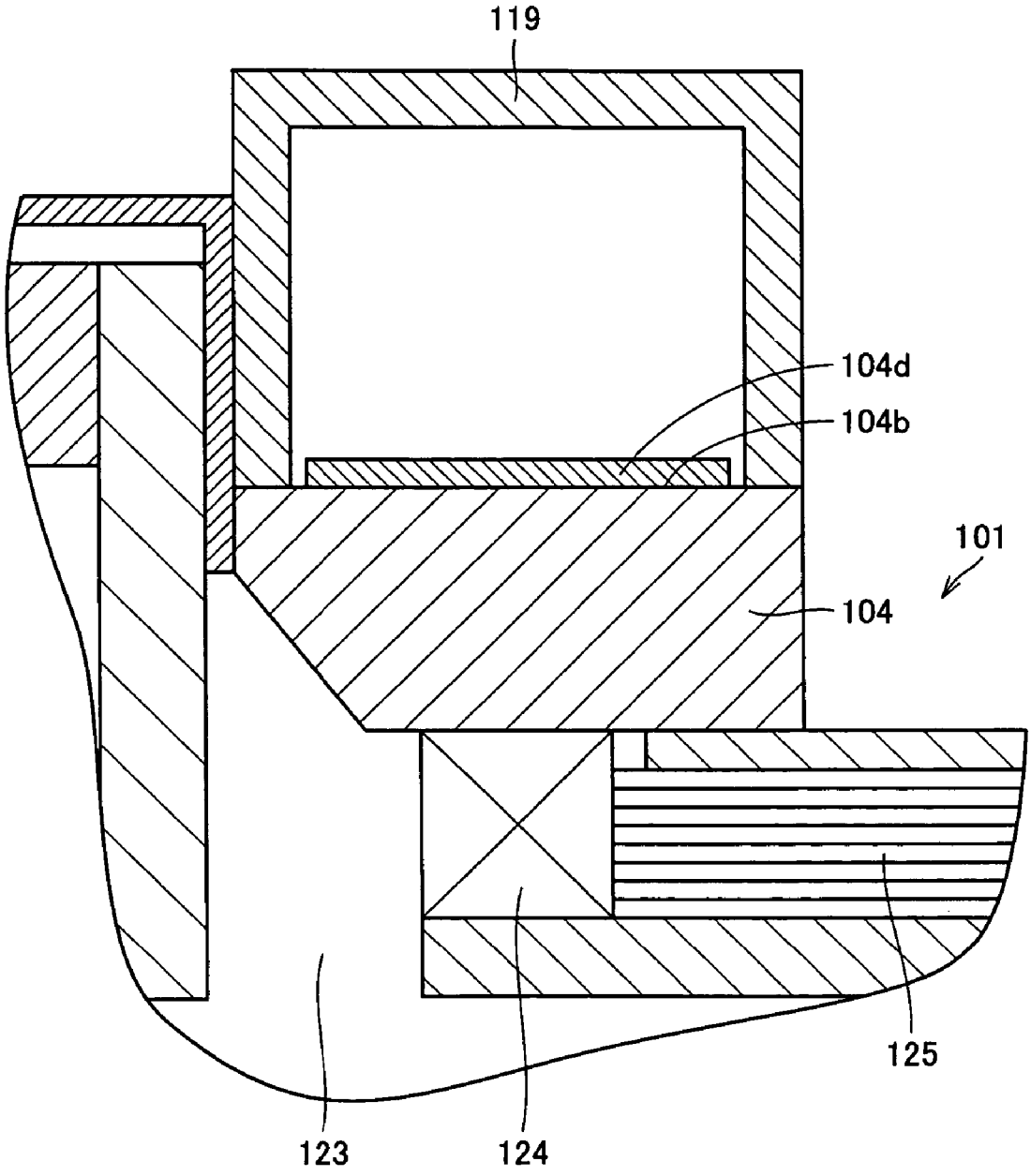
FIG. 19 is a partial cross section of a Stirling refrigerating machine and a loop thermosyphon showing an exemplary configuration of the present heat radiation system in a third embodiment.

The present embodiment provides as well as the second embodiment a heat radiation system adopting a loop thermosyphon to externally radiate heat generated at a Stirling refrigerating machine. FIG. 19 is a partial cross section of a Stirling refrigerating machine and a loop thermosyphon for illustrating an exemplary configuration of the heat radiation system in the present embodiment.

As shown in FIG. 19, Stirling refrigerating machine 101 has heat radiating portion 104 surrounding a heat source or a compression section 123 provided with an internal heat exchanger 124 through which heat radiating portion 104 recovers heat generated in compression section 123. Heat radiating portion 104 has an external wall surface 104*b* having for example welded thereto and thus assembled outer frame 116 defining an evaporator of the loop thermosyphon. Note that at internal heat exchanger 124 closer to an expansion section a reproducer 125 is arranged.

In the present embodiment the loop thermosyphon has the evaporator that is configured only of an annular frame 119 and does not include inner frame 115 as described in the second embodiment. More specifically, the evaporator is formed of annular frame 119 that has a path for a working fluid therein and has an opening closer to heat radiating portion 104 of Stirling refrigerating machine 101 as seen in a cross section including the axial line of annular frame 119. As such, after annular frame 119 is for example welded and thus attached to heat radiating portion 104, the path will be defined by an internal wall surface of annular frame 119 and external wall surface 104*b* of heat radiating portion 104 positioned to close the opening.

In the present embodiment the heat radiation system has a roughened or processed surface 104*d* at heat radiating portion 104 of Stirling refrigerating machine 101 on external wall surface 104*b* at a portion facing the path of the working fluid. This allows the heat radiating portion to provide heat directly to the working fluid and also ensures that the heat radiating portion contacts the working fluid over a large area. The working fluid can efficiently be evaporated and the loop thermosyphon can more efficiently cool the heated portion.

Figure 20:
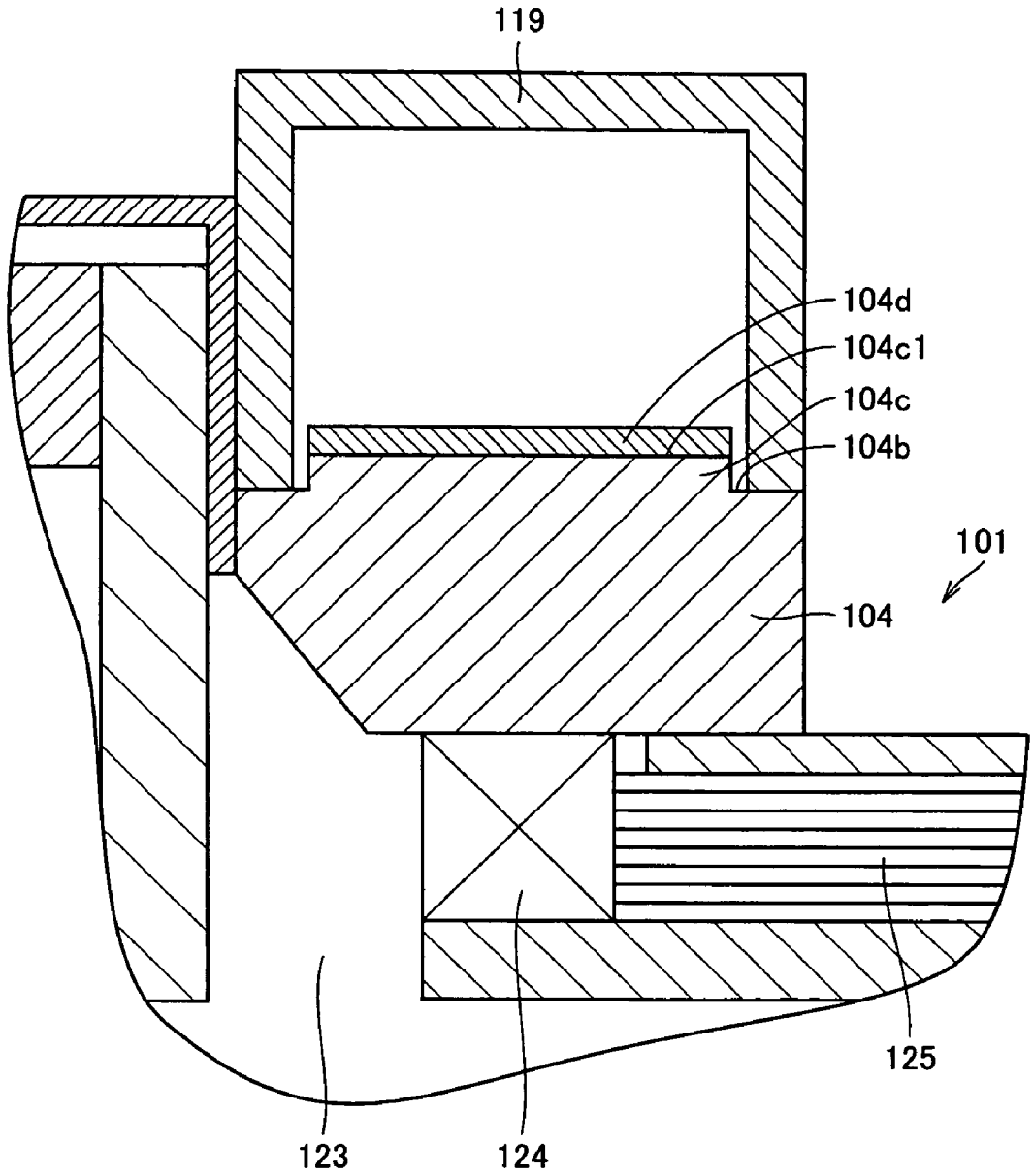
FIG. 20 is a partial cross section of a Stirling refrigerating machine and a loop thermosyphon showing an exemplary variation of the present heat radiation system in the third embodiment.

FIG. 20 is a partial cross section of a Stirling refrigerating machine and a loop thermosyphon showing an exemplary variation of the heat radiation system in the present embodiment. As shown in FIG. 20, this heat radiation system, as well as that in the second embodiment, includes a plateau 104*c* at heat radiating portion 104 of a Stirling refrigerating machine on an external wall surface at a portion facing the path of the working fluid, and plateau 104*c* has a top surface 104*c*1 provided with a roughened, processed surface 104*d* to effectively prevent a brazing material from flowing into the path in welding.

Fourth Embodiment

Figure 21:
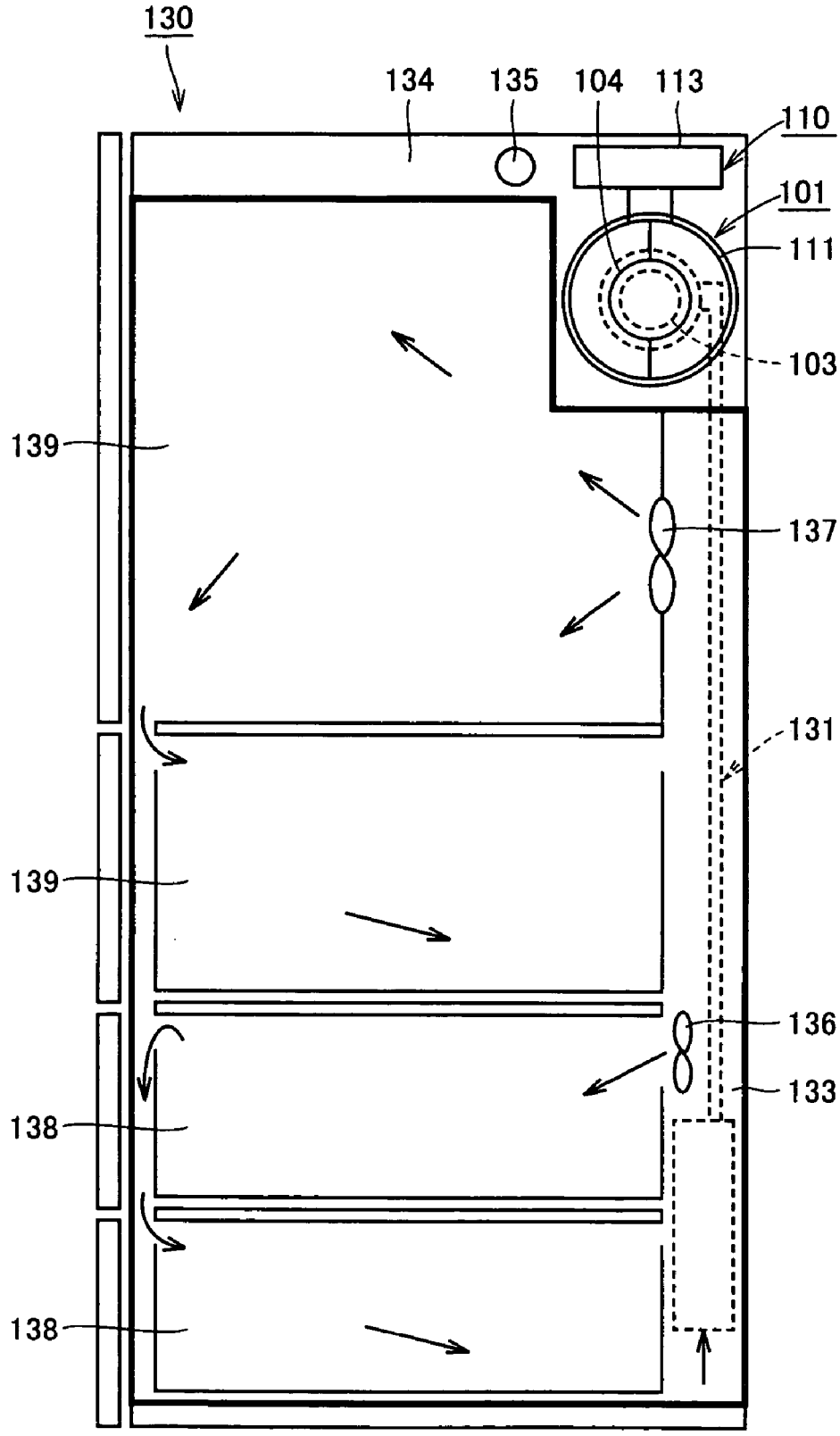
FIG. 21 is a schematic, longitudinal cross section of a Stirling refrigerator of the present invention in a fourth embodiment.

FIG. 21 is a schematic cross section of a structure of a Stirling refrigerator of the present invention in a fourth embodiment. This Stirling refrigerator has mounted therein the Stirling refrigerating machine and loop thermosyphon described in the second or third embodiment.

As shown in FIG. 21, a Stirling refrigerator 130 includes a freezer section 138 and a chiller section 139 as a refrigeration section. Stirling refrigerator 130 includes loop thermosyphon 110 as a heat transfer system associated with a heat radiating portion to cool heat radiating portion 104 of Stirling refrigerating machine 101. Stirling refrigerating machine 101 has heat absorbing portion 103 generating cryogenic temperature which is utilized by a heat transfer system 131 associated with the heat absorbing portion (see a portion in FIG. 21 that is indicated by a broken line) to cool inside the refrigerator. As well as the heat transfer system associated with the heat radiating portion, the heat transfer system associated with the heat absorbing portion may also be configured of a loop thermosyphon or may be a heat transfer system utilizing forced convection.

The heat transfer system associated with the heat radiating portion, or loop thermosyphon 110, includes evaporator 111 attached to surround and thus contact heat radiating portion 104 of Stirling refrigerating machine 101, and condenser 113 connected to evaporator 111 by a feed pipe and a return pipe. Evaporator 111, condenser 113 and the feed and return pipes form a circulation circuit having ethanol-added water or the like sealed therein as a coolant. To allow the coolant's evaporation and condensation and resultant natural circulation to be utilized to transfer heat generated at heat radiating portion 104, condenser 113 is arranged to be upper (or higher) than evaporator 111.

As shown in FIG. 21, Stirling refrigerating machine 101 is arranged in Stirling refrigerator 130 at a rear, upper portion. Furthermore, heat transfer system 131 associated with the heat absorbing portion is arranged in Stirling refrigerator 130 closer to the rear side. In contrast, the heat transfer system associated with the heat radiating portion, or loop thermosyphon 110, is arranged in Stirling refrigerator 130 at an upper portion. Note that thermosyphon 110 has condenser 113 provided in a duct 134 provided in Stirling refrigerator 130 at an upper portion.

When Stirling refrigerating machine 101 is operated, heat radiating portion 104 generates heat, which is thermally exchanged via condenser 113 of thermosyphon 101 with air present in duct 134. An air blowing fan 135 exhausts warm air present in duct 134 external to Stirling refrigerator 130 and also takes in air external to Stirling refrigerator 130 to help to exchange heat.

In contrast, heat absorbing portion generates cryogenic temp, which is thermally exchanged with a stream present in cold duct 133, as indicated in FIG. 21 by an arrow. A fan 136 associated with a freezer section and a fan 137 associated with a chiller section blow cool air toward freezer section 138 and chiller section 139, respectively. Each refrigeration section 28, 29 provides a warm stream which is again introduced into cold duct 133 and repeatedly cooled.

The above described Stirling refrigerator has mounted therein a heat radiation system as described in the second or third embodiment and hence efficiently cooling a heated portion. This allows a Stirling refrigerating machine to be operated significantly efficiently and also enhances the Stirling refrigerator in performance.

The features in the loop thermosyphon, heat radiation system, heat exchange system and Sterling refrigerator described in the first to fourth embodiments can mutually be combined together to provide dramatically increased efficiency in cooling a heated portion.

Furthermore the embodiments have been described for a heat radiation system including a loop thermosyphon that is applied to a heat transfer system of a Stirling refrigerating machine that is associated with a heat radiating portion by way of example, the system is as a matter of course applicable to different devices having a heat source.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A heat exchange system comprising:

an annular evaporator surrounding a heat radiating portion to have an axis extending horizontally to evaporate a coolant in said evaporator;

a condenser condensing said coolant;

a conduit guiding said coolant from said evaporator to said condenser; and a return pipe returning from said condenser to said evaporator said coolant condensed by said condenser, wherein said conduit has an opening at an outer circumferential surface of said evaporator;

said return pipe has an opening in said evaporator at a gaseous coolant area;

said return pipe has said opening separated from said outer circumferential surface of said evaporator;

said conduit is larger in diameter than said return pipe;

said evaporator is divided into two sub evaporators;

said conduit and said return pipe are connected to each of said two sub evaporators; and said two sub evaporators are coupled together by a connection pipe to allow said two sub evaporators to communicate a liquid coolant therebetween.

2. The heat exchange system according to claim 1, wherein said conduit is connected to said evaporator at an said outer circumferential surface and said return pipe is connected to said evaporator at an axial end surface.

3. A Stirling refrigerator having said evaporator of the heat exchange system of claim 1 attached to a Stirling refrigerating machine at a heat radiating portion to allow the system to cool said heat radiating portion.

4. The heat exchange system according to claim 1, wherein:

said two sub evaporators each have a circumferential end surface in said gaseous coolant area, and said return pipe has said opening closer to said circumferential end surface than said opening of said conduit.

* * * * *